US011591766B2

(12) United States Patent
Queen et al.

(10) Patent No.: US 11,591,766 B2
(45) Date of Patent: Feb. 28, 2023

(54) MOBILE SEGMENTAL RAIL FOUNDATION SYSTEM

(71) Applicant: Foundation Technologies, Inc., Lawrenceville, GA (US)

(72) Inventors: Frank A. Queen, Dacula, GA (US); Matthew John Garry, Weatherford, TX (US)

(73) Assignee: FOUNDATION TECHNOLOGIES, INC., Lawrenceville, GA (US)

( * ) Notice: Subject to any disclaimer, the term of this patent is extended or adjusted under 35 U.S.C. 154(b) by 0 days.

(21) Appl. No.: 17/091,720

(22) Filed: Nov. 6, 2020

(65) Prior Publication Data

US 2021/0131055 A1 May 6, 2021

Related U.S. Application Data

(60) Provisional application No. 62/931,573, filed on Nov. 6, 2019.

(51) Int. Cl.
*E02D 27/01* (2006.01)
*E02D 5/80* (2006.01)

(52) U.S. Cl.
CPC ..... *E02D 27/01* (2013.01); *E02D 5/801* (2013.01); *E02D 2600/30* (2013.01)

(58) Field of Classification Search
CPC ..... E02D 27/01; E02D 5/801; E02D 2600/30; F24S 25/617; F24S 25/12; F24S 25/65
USPC ..... 52/155–166
See application file for complete search history.

(56) References Cited

U.S. PATENT DOCUMENTS 8,528,296 B1 * 9/2013 Miller ..... E02D 27/42 52/741.15
8,707,636 B1 * 4/2014 Toson ..... E04H 13/003 52/741.11
10,260,211 B2 * 4/2019 Peterson ..... E04H 1/1205
2010/0293870 A1 * 11/2010 Amengual Pericas . E01F 9/685 52/155
2011/0138736 A1 * 6/2011 Brown ..... E02D 27/50 52/741.11
2013/0037088 A1 * 2/2013 Thurner ..... F24S 25/12 136/251
2018/0340310 A1 * 11/2018 Peterson ..... E04H 1/1205

* cited by examiner

*Primary Examiner* — Brian D Mattei
*Assistant Examiner* — Omar F Hijaz
(74) *Attorney, Agent, or Firm* — Thomas | Horstemeyer, LLP

(57) ABSTRACT

Various examples are provided related to mobile segmental rail foundation systems, and their assembly, deployment and use. In one example, among others, a mobile rail foundation system includes a segmental rail foundation including a plurality of anchor assemblies and at least one sectional spacer rail assembly configured to detachably attach adjacent anchor assemblies to form the segmental rail foundation. The anchor assemblies can be coupled to soil anchor assemblies and/or hold down assemblies to secure the segmental rail foundation in position. The soil anchor assemblies can include helical pile soil anchor assemblies and the hold down assemblies can include forked hold down plate or brackets secured by anchor bolts.

23 Claims, 16 Drawing Sheets

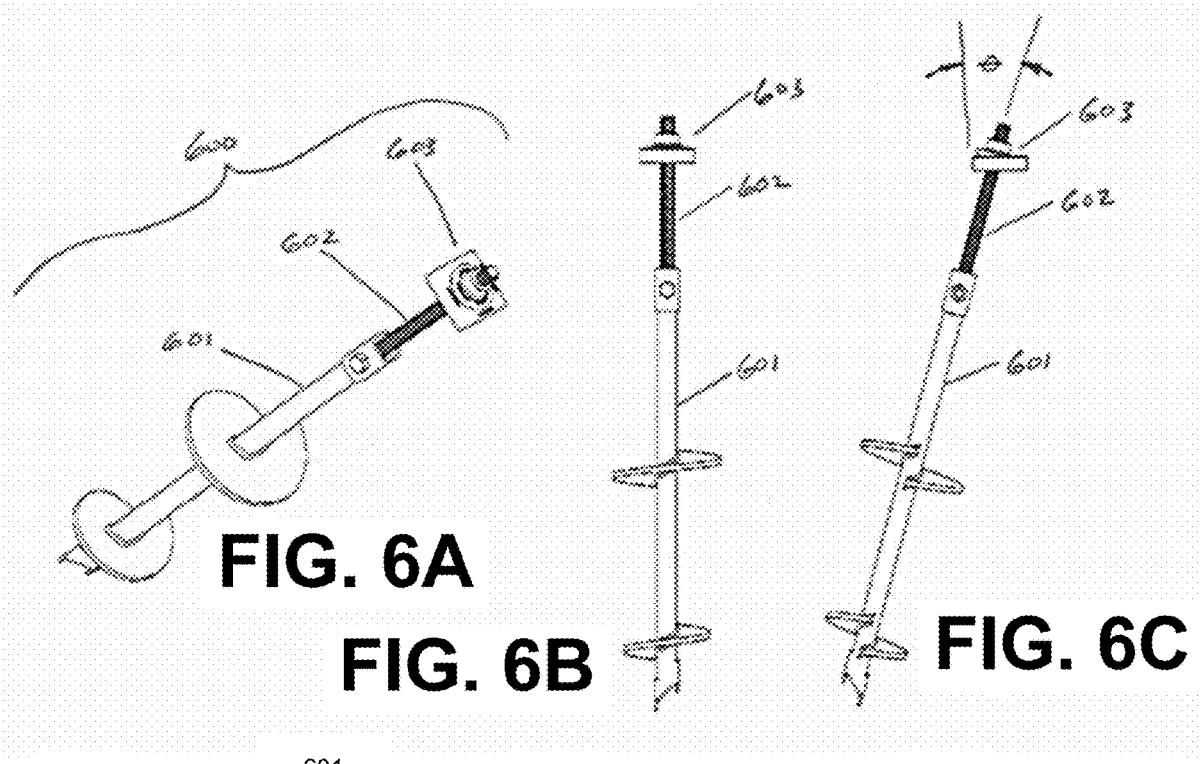
FIG. 6A
FIG. 6B
FIG. 6C
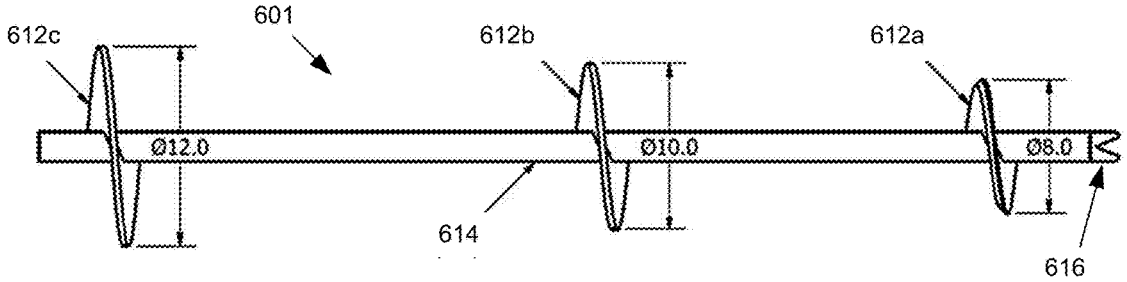
FIG. 6D
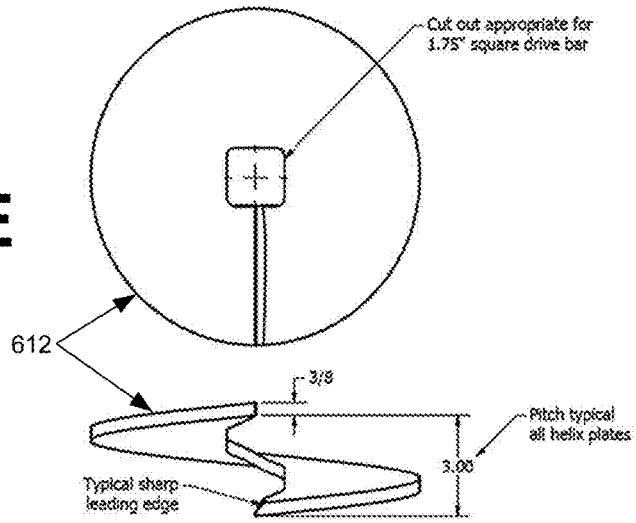
FIG. 6E

MOBILE SEGMENTAL RAIL FOUNDATION SYSTEM

CROSS REFERENCE TO RELATED APPLICATIONS

This application claims priority to, and the benefit of, U.S. provisional application entitled "Mobile Segmental Rail Foundation System" having Ser. No. 62/931,573, filed Nov. 6, 2019, which is hereby incorporated by reference in its entirety.

BACKGROUND

Rapid deployment initiatives whether for military expeditionary campaigns, humanitarian crisis or emergency disaster relief require prompt and expeditious response in most cases. Conditions can be hazardous and readily available construction materials are often are not available for the construction or re-construction of depleted, damaged or required infrastructure. In the light of these challenges and difficult logistics associated with these type of response initiatives, construction materials and designs must be engineered to accommodate for the adversities faced during such events. Many of the responses involve remote locations that lack manpower, equipment and materials necessary to respond in short order.

For first responders and expeditionary initiatives speed of construction is of utmost importance. These structures are critical to these missions, and these structures need to be erected expediently and require these proprietary, engineered and robust structural foundations. There are many ways to complete this task where there is a readily available supply of the conventional construction materials necessary to complete the task at hand. Conventional foundation elements and current practices consist of reinforced concrete, steel or concrete piling and specialty foundation systems that are cumbersome, mandate the utilization of more and larger pieces of equipment for installation that require considerable maintenance, systems that require extensive training and expertise to install, and methods that are reliant on substantial infrastructure and materials in support of the application. However, where these materials, equipment, and infrastructure are in short supply, foundation construction becomes a major problem to solve.

SUMMARY

The present disclosure relates generally to a proprietary and specially designed mobile rapid response system using an anchored segmental rail foundation capable of supporting structures in tension, compression or in a combination of both tension and compression. The rail foundation system can utilize a single component segmental rail support or utilize plural segmental rails in a specific support application. The foundation system allows for segmental fabrication so that the pieces can be economically manufactured, shipped, handled, and rapidly deployed in the field with minimal equipment requirements. Once assembled in the field and affixed to the earth, the rapid response system will provide instant support and stability to the mounted superstructure.

The segmental structural compression/tensioning foundation system can be used for rapid deployment in support of military expeditionary forces, emergency disaster relief, humanitarian crisis and utilization in remote locations around the world where a readily available source of concrete is non-existent. The system can be segmentally fabricated, capable of being shipped in a limited number of Conex containers, easily handled, shipped and quickly installed on site utilizing small readily available equipment. The structural base can provide for the erection and support of a superstructure through a proprietary process of mechanically coupling and affixing the rail foundation to the earth; resulting in a very durable and robust heavy-duty foundation element.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims. In addition, all optional and preferred features and modifications of the described embodiments are usable in all aspects of the disclosure taught herein. Furthermore, the individual features of the dependent claims, as well as all optional and preferred features and modifications of the described embodiments are combinable and interchangeable with one another.

BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

FIG. 2D illustrates examples of an end anchor assembly, a center anchor assembly, and a sectional spacer rail extension assembly, in accordance with various embodiments of the present disclosure.

FIG. 6A is a perspective view of an example of a helical pile soil anchor with self-aligning anchorage termination, in accordance with various embodiments of the present disclosure.

FIG. 6B is a side elevation of the helical pile soil anchor of FIG. 6A at about 0° inclination, in accordance with various embodiments of the present disclosure.

FIG. 6C is a side elevation of the helical pile soil anchor of FIG. 6A at about 15° inclination, in accordance with various embodiments of the present disclosure.

FIGS. 6D-6G illustrate an example of a helical soil pile anchor, in accordance with various embodiments of the present disclosure.

DETAILED DESCRIPTION

Figure 1A:
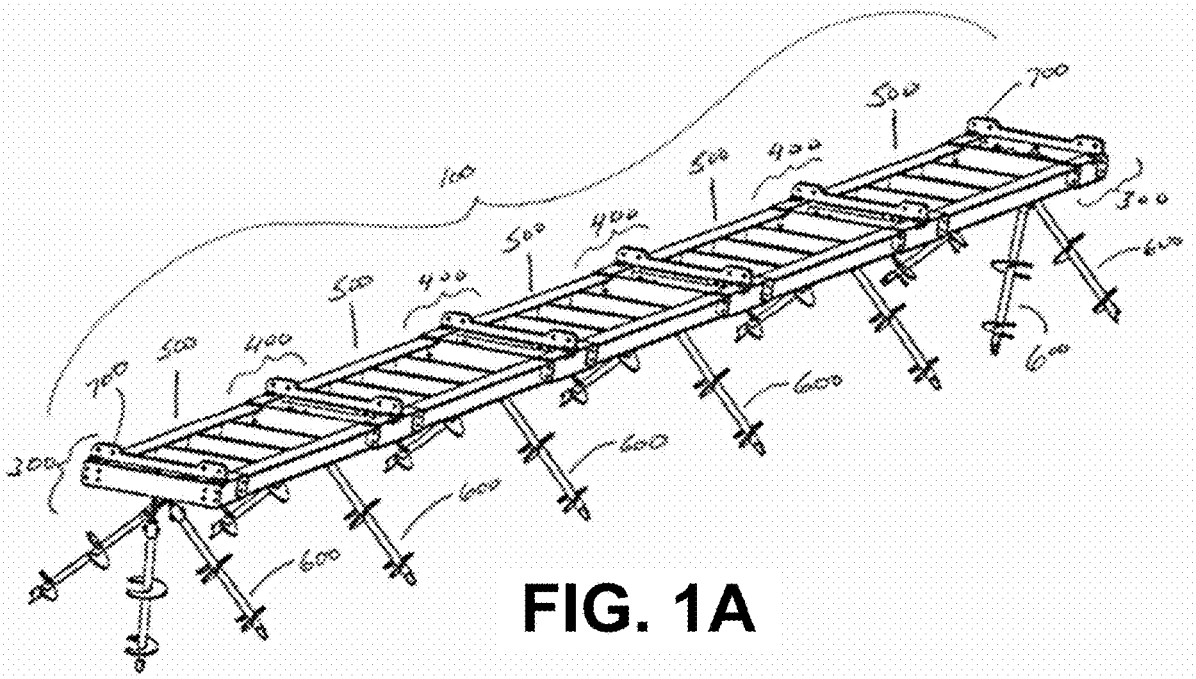
FIG. 1A is a perspective view of an example of a segmental rail foundation, in accordance with various embodiments of the present disclosure.

The present disclosure can be understood more readily by reference to the following detailed description, examples, drawings, and claims, and their previous and following description. It is to be understood that this disclosure is not limited to the specific assemblies, systems, and/or methods disclosed unless otherwise specified, and, as such, can, of course, vary. It is also to be understood that the terminology used herein is for the purpose of describing particular aspects only and is not intended to be limiting. To this end, those skilled in the relevant art will recognize and appreciate that many changes can be made to the various aspects of the disclosure, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

For clarity, it will be appreciated that this disclosure will focus primarily on the perspective view of an anchored segmental rail system comprising a plurality of segmental rail assemblies. As such, it is contemplated that the described features of the elements forming an anchored segmental rail system can also extend to the respective elements of a singular segmental rail assembly.

As used throughout, the singular forms "a," "an" and "the" include plural referents unless the context clearly dictates otherwise. Thus, for example, reference to "an opening" can include two or more such openings unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance can or cannot occur, and that the description includes instances where said event or circumstance occurs and instances where it does not.

The word "or" as used herein means any one member of a particular list and also includes any combination of members of that list. Further, one should note that conditional language, such as, among others, "can," "could," "might," or "can," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily include logic for deciding, with or without user input or prompting, whether these features, elements and/or steps are included or are to be performed in any particular embodiment.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutation of these cannot be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific embodiment or combination of embodiments of the disclosed methods.

Disclosed herein are various examples related to mobile segmental rail foundation systems, and their assembly, deployment and use. Understanding the need for rapid deployment to a particular destination, and the manner first responders engage is beneficial to understanding the mobile segmental rail foundation system. Attention to the amount of resources needed to fulfill a rapid deployment directive while minimizing freight, materials and labor is important to providing a solution. The rail foundation systems can offer a controlled modular means of improved logistical movement including containerization, handling and sequential systematic freight deployment of a remote structural foundation support system to be integrated with a specific structure utilizing segmental and coupled variable section modulus rail sections. When coupled and affixed to the earth with specified and sized helical anchors and associated terminations, the rail foundation system can form a continuous mechanical foundation element capable of supporting variable structural designs.

Solutions for a mobile infrastructure foundation are lacking, if not non-existent. This is particularly true when sourcing a mobile infrastructure foundation that is capable of supporting substantial and variable engineered superstructure loads. The mobile rapidly deployed anchored segmental rail foundation system design can provide a pre-engineered foundation system to be expeditiously mobilized in order to support the erection of rapidly deployed structures in remote adverse environments and climates where conventional construction materials are not readily, and will not be readily, available.

Mechanical soil anchors (e.g., helical anchors) can be used for resisting tensional loads imposed upon structures. Over the past 30 or so years, the technology behind mechanical soil anchors has advanced to the point where anchors are capable of supporting similar loads in compression as well as tension, but these anchors are designed to accommodate additional variable load conditions.

Helical piles and anchors can be installed by torqueing them into the ground utilizing a single or series of sized helical plates that are bore into a strong bearing stratum of soil capable of supporting a specified load in tension or compression. The foundation elements can be sequentially coupled together utilizing bolts through the coupling for connection and torsional resistance during the helical installation process. Upon reaching a specific torque correlated depth capable of supporting the specific desired load, the installation can be terminated, and a specific termination fixture can then be affixed to the end of the foundation element in the application.

Helical soil anchors are excellent for affixing the segmental rail foundation to the earth in either tension or compression. Helical anchors have a direct torque to capacity relationship. QA/QC for the foundation elements of the modular deep foundation system can be easily monitored by tracking the applied torque during installation. Due to a helical anchor's high strength, proven and tested (proof tested as they are torqued into the earth) capabilities, and of sectional pre-fabricated design; they make the perfect deep foundation element solution for incorporation into the segmental rail foundation system. The segmental design provides for a highly favorable modular means of accommodating overseas Conex shipments or air freight transport.

The soil anchors can be integrated with the segmental foundation rails utilizing engineered mechanical connections in tension and/or compression that carry a superstructure load to pivotal foundation supports mounted on the rails. The utilization of mechanical connections can eliminate the need for welding in the field saving the cost of a welding machine as well as a certified welder. The sectional system can provide for lean-construction in a unique foundation alternative to conventional foundation systems that rely on concrete supply, reinforcing steel, foundation piles or heavy construction equipment and materials that might be needed alternatively. The rail foundation design is a mobile, lightweight, less labor intensive, less equipment intensive system pre-fabricated especially for the logistics of Conex ocean freight and piece mill erection; this system has less moving parts. It is not reliant on reinforced concrete, heavy foundation elements nor the material logistics associated with concrete manufacturing and delivery.

In a rapid deployment application, the segmental rail design can be easily freighted logistically to a specified destination. Upon arriving at a referenced destination, the materials can be easily offloaded along with the structure to be supported. The segmental connecting nature of the proprietary helical anchor system provides for a durable and robust foundation element that can be man handled sectionally in the field. Immediately upon fitting up the available equipment on-site with the proper torqueing and ancillary equipment used for the installation, work can begin. The rail foundation frame is segmentally connected, and work can begin on the superstructure framework coinciding with the helical anchor installation. The mobile rail foundation system is uniquely designed for rapid deployment of steel structures to remote and adverse environments, and the proprietary design and construction process can save many man-hours drastically reducing overall construction time.

Described herein is a mobile rapidly deployed anchored segmental rail foundation system and a proprietary method of incorporating a rail design with a helical anchor foundation element design capable of resisting the structural loads imposed upon a modular connecting foundation rail design by the superstructure of a building in either tension or compression or in both tension and compression. In one aspect, the connecting modular rail foundation is designed and capable of supporting the structural framework of a structure. In yet another aspect, the helical anchor foundation elements in tension and compression can be installed to coincide with the construction of the structural framework of a building construction.

A unique and proprietary characteristic of the mobile rapidly deployed anchored segmental rail foundation system is that it can be applied to fit up in a singular rail or plural rail design. The structure to be supported and its applied load whether in tension or compression will determine the type, weight and overall size of the rails to be utilized.

Since the rail system is segmental to fit within shipping containers to accommodate rail, sea, land and air logistics for delivery, a plate can be affixed to the ends of each rail to provide for easy and quick field fit up utilizing bolted connections for speed of construction. This mechanical field fit-up provides simplicity and rigidity to the foundation which allows for a quick and stable set up at the site for erection purposes.

The foundation rail system is distinctively different in application from a conventional means in that allows for methodical and mechanical build out construction to mobilize to a given site saving freight, materials and labor in more compact operational response with minimal equipment necessary for the task; this is of utmost importance to the first responders in that such condensed operations provide a quality high-end solution that eventually saves considerable capital outlay over conventional construction processes while providing an economic, simplified erection solution to meet a fast track building schedule requirement.

Figure 1B:
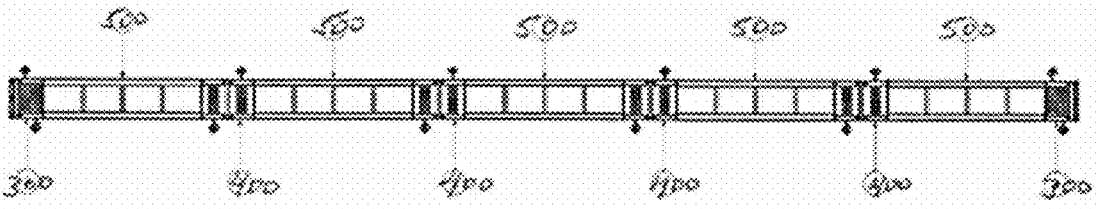
FIG. 1B is a top elevation of the segmental rail foundation of FIG. 1A, in accordance with various embodiments of the present disclosure.
Figure 1C:
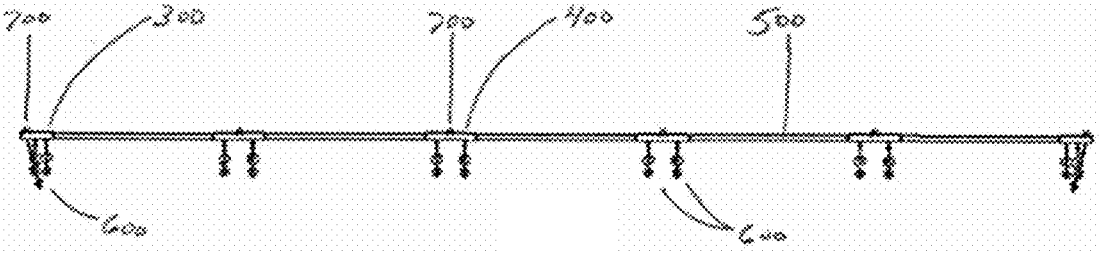
FIG. 1*c* is a side elevation view of the segmental rail foundation of FIG. 1A, in accordance with various embodiments of the present disclosure.

Reference will now be made in detail to the description of the embodiments as illustrated in the drawings, wherein like reference numbers indicate like parts throughout the several views. Referring to FIGS. 1A-1C, shown are views of a segmental rail foundation 100 in accordance with various aspect of the present disclosure. The segmental rail foundation 100 can comprise end anchor assemblies 300, center anchor assemblies 400, sectional spacer rail assemblies 500, and soil anchor assemblies 600 (e.g., helical pile soil anchor assemblies) arranged to coordinate with the size of the superstructure construction being supported by the segmental rail foundation 100. Pivotal foundation supports 700 are provided as the connection between the segmental rail foundation 100 and the superstructure.

FIGS. 2A-2D illustrate a segment of the segmental rail foundation 100, which includes a sectional spacer rail assembly 500 between an end anchor assembly 300 and a center anchor assembly 400. The assemblies 300, 400 and 500 can be coupled together by fasteners (e.g., bolts, screws, or other appropriate fasteners), which can facilitate later disconnection. The segmental rail foundation 100 can be anchored to the underlying surface by the soil anchor assemblies 600. As can be seen in FIGS. 2A-2D, the end anchor assembly 300 is coupled to three soil anchor assemblies 600 oriented at different angles for stability and the center anchor assembly is coupled to two soil anchor assemblies 600. Pivotal foundation supports 700 are coupled to the end and center anchor assemblies 300 and 400 over the soil anchor assemblies 600.

Figure 6F:
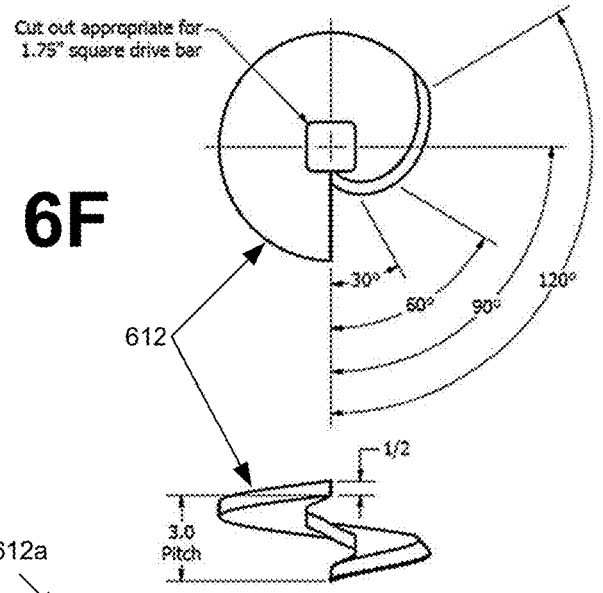

FIGS. 6A-6C illustrate an example of helical soil anchor assemblies 600 comprising a helical soil pile anchor 601, an externally threaded rod 602, and a self-aligning anchorage termination 603. Helical soil pile anchors 601 can be driven into the soil substrate creating a high capacity deep foundation support system. FIGS. 6D-6F illustrate an example of a helical soil pile anchor 601. As shown in FIGS. 6A-6F, the helical soil pile anchors 601 can comprise a plurality of helical plates 612 distributed along a drive shaft 614. The distal end of the drive shaft 614 can comprise a tip 616 shaped to facilitate insertion of the helical soil pile anchor 601 into the soil. For example, the tip 616 can taper across the width of the drive shaft 614 (e.g., from a first side to a second side) with an inverted v-notch cut through the tapered tip as illustrated in FIG. 6D.

The helical plates 612 can be asymmetrically distributed along the length of the drive shaft 614. For example, the distance between helical plates 612*a* and 612*b* can be less than the distance between helical plates 612*b* and 612*c* (e.g., separations of 24 and 30 inches). The lowest helical plate 612 is offset from the tip 616 by a fixed distance. The size of the helical plates 612 can vary along the length of the helical soil plate anchor 601. For example, the outer diameter of the helical plates can increase along the length from the distal end. In the example of FIG. 6D, the helical plate diameters are illustrated as 8 inches (plate 612*a*), 10 inches (plate 612*b*) and 12 inches (plate 612*c*). In addition, the helical plates 612 can include a single turn having a fixed pitch. By using the same pitch for all of the helical plates 612, the helical soil pile anchor 601 is evenly advanced into the soil as it is rotated. The drive shaft 614 can have a geometric cross-section (e.g., square, hexagonal, octagonal, etc.) to facilitate transfer of the rotational torque to the helical plates 612.

Figure 6G:
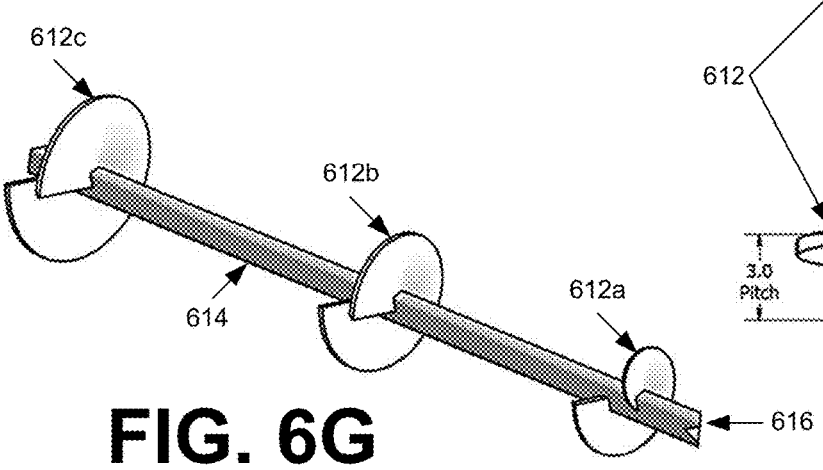

FIG. 6E includes top and side views of an example of a helical plate 612 including a square opening or cutout to receive the drive shaft 614. In some embodiments, the lowest helical plate can have a seashell edge design as shown in FIG. 6F. As illustrated, the leading edge of the helical plate rotates outward from the center to facilitate cutting into the soil as the drive shaft 614 is rotated. FIG. 6G is a perspective view of a helical soil plate anchor 601 with the lowest helical plate 612*a* having a seashell edge design.

Figure 7A:
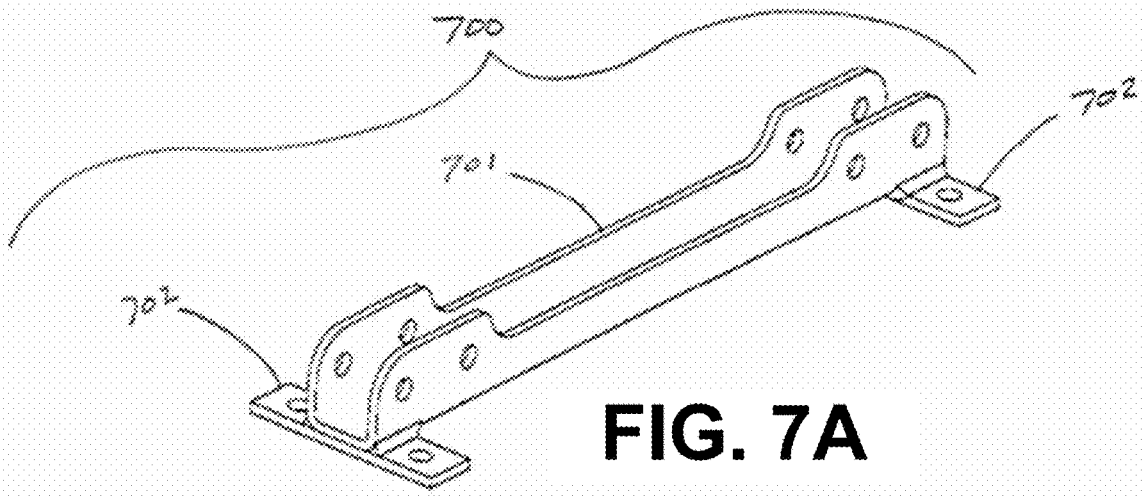
FIG. 7A is a perspective view of an example of a pivotal foundation support, in accordance with various embodiments of the present disclosure.
Figure 7B:
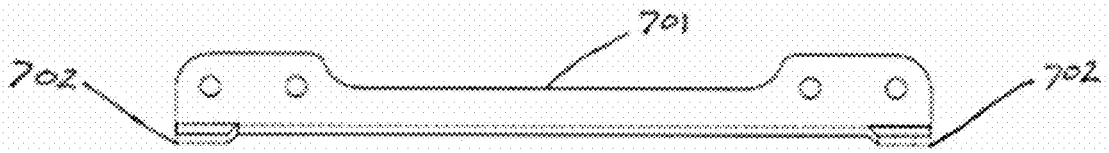
FIG. 7B is a side elevation of the pivotal foundation support of FIG. 7A, in accordance with various embodiments of the present disclosure.

The pivotal foundation support 700 in FIGS. 7A and 7B, is a weldment comprising a u-bracket 701 and a pair of support brackets 702. The pivotal foundation support 700 is matched to accept and support the load of the mobile structure and provide transfer of the load to the soil through the segmental rail foundation 100 and soil anchor assemblies 600.

Figure 3A:
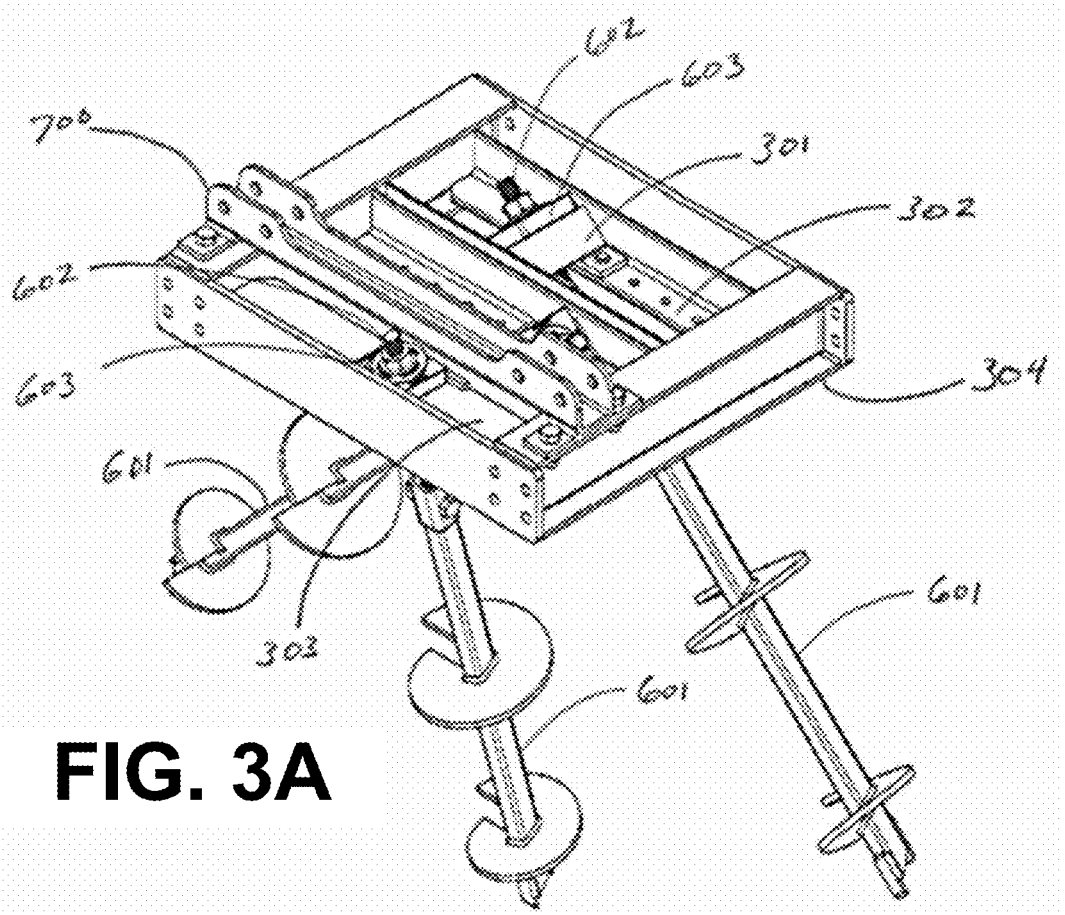
FIG. 3A is a perspective view of the end anchor assembly of FIG. 2D, in accordance with various embodiments of the present disclosure.
Figure 3B:
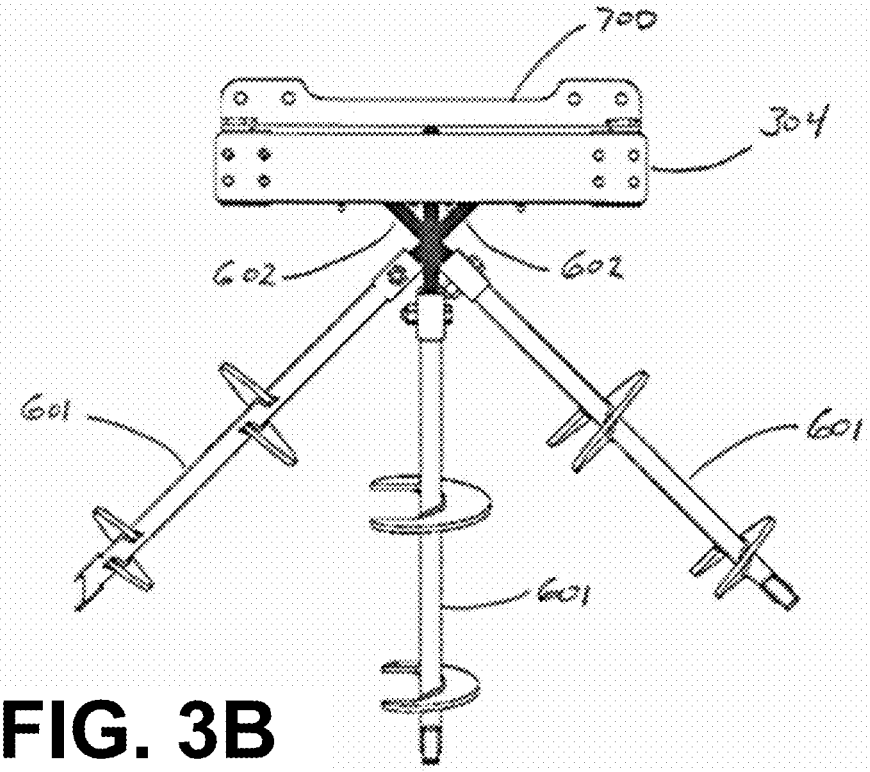
FIG. 3B is a front elevation of the end anchor assembly of FIG. 3A, in accordance with various embodiments of the present disclosure.
Figure 3C:
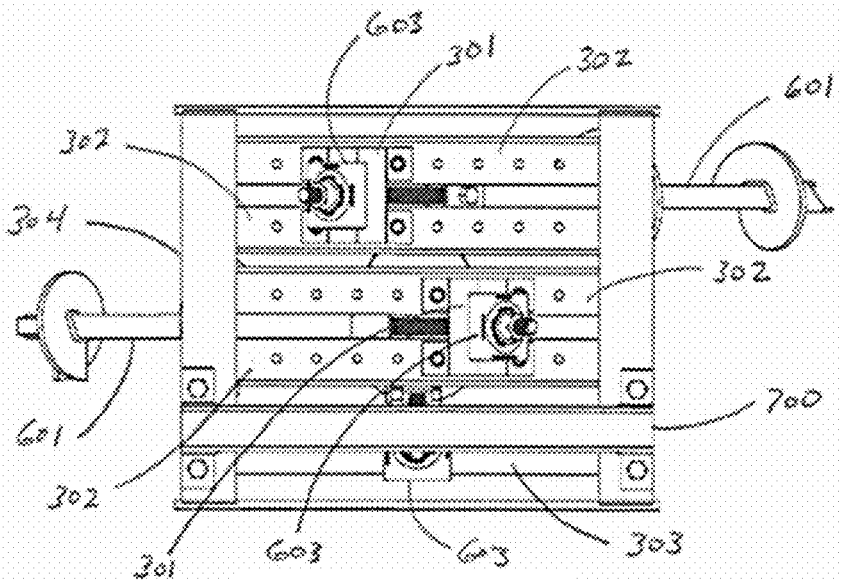
FIG. 3C is a top elevation of the end anchor assembly of FIG. 3A, in accordance with various embodiments of the present disclosure.

The end anchor assembly 300, shown in detail in FIG. 3A, comprises a welded structural steel frame 304 used to provide construction support for adjustable cross slide angles 302 and cross support weldments 301 to allow for adjusting locations for the laterally driven helical pile soil anchor assembly 600. Mounted in structural steel frame 304, is the end cross slide channel 303 allowing for positioning of the longitudinally driven helical pile soil anchor assembly 600. A pivotal foundation support 700 is provided for robust attachment to the superstructure during construction. The welded structural steel frame 304 is prepared to accept a sectional spacer rail assembly 500 as required by the length of the desired mobile structure to be constructed.

Figure 3D:
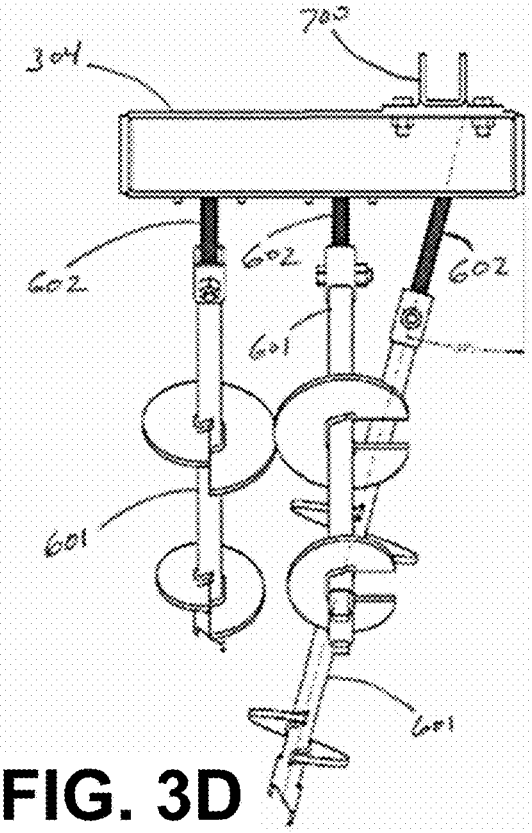
FIG. 3D is a side elevation view of the end anchor assembly of FIG. 3A, in accordance with various embodiments of the present disclosure.
Figure 3E:
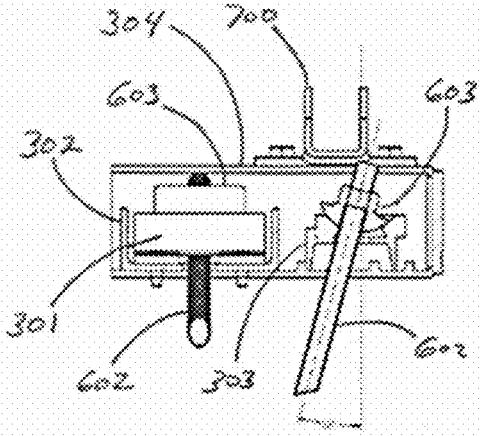
FIG. 3E is a side cross-sectional view of the end anchor assembly of FIG. 3A, in accordance with various embodiments of the present disclosure.

For the end anchor assembly 300 shown in FIGS. 3D and 3E, helical soil pile anchors 601 are driven in for lateral support at approximately 45 degree angle and for longitudinal support at approximately 15 degrees. The angle of the lateral and longitudinal supports can vary based upon the soil conditions. For example, the helical soil pile anchors 601 can be driven in substantially vertically (approximately zero degrees or normal to the surface), or can be at an angle in a range from about 0 degrees to about 75 degrees, in a range from about 10 degrees to about 60 degrees, or in a range from about 15 degrees to about 45 degrees. The difference in the angles of the lateral and longitudinal supports can be in a range from about 15 degrees to about 60 degrees, in a range from about 15 degrees to about 45 degrees, or about 30 degrees. Once driven in place, a threaded rod 602 can be attached to each helical soil anchor 601 which is then extended through the cross support weldment 301 or the end cross slide channel 303. The self-aligning anchorage termination 603 is placed concentrically over the threaded rod 602 and affixed to transfer the tension or compression load bearing capacity of the soil stratum to the end anchor assembly 300.

Figure 4A:
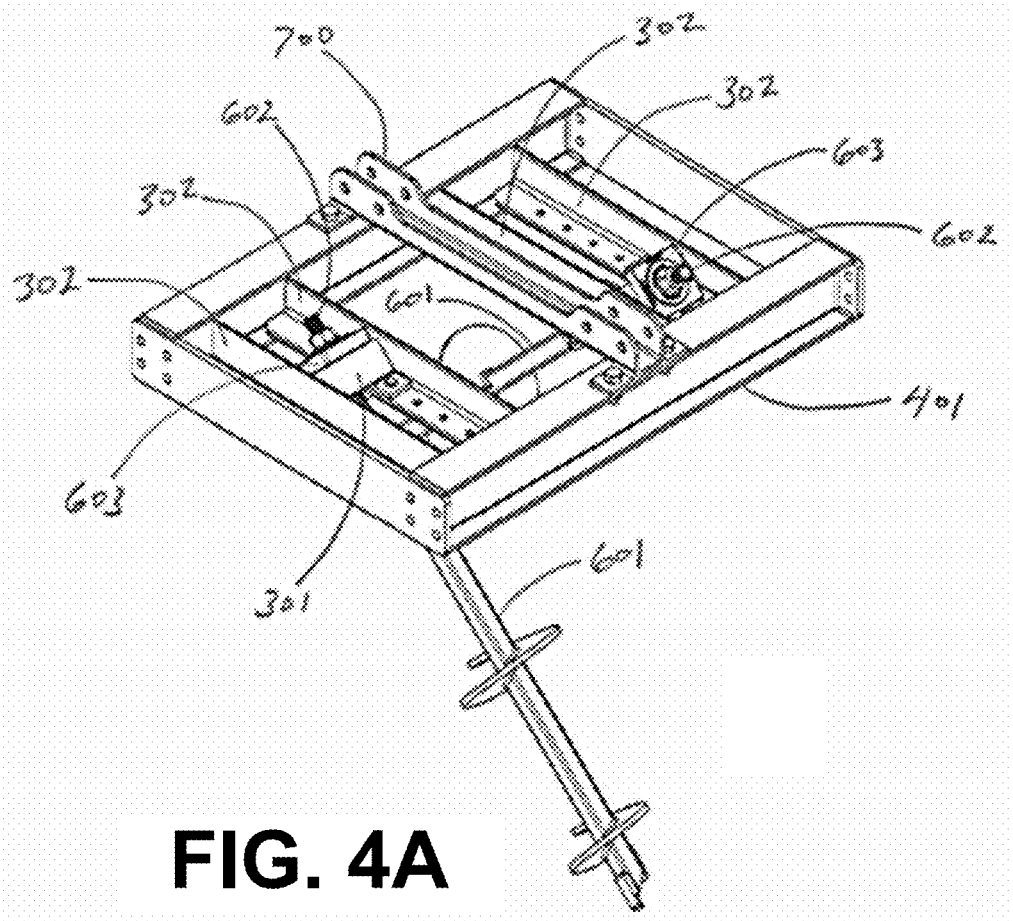
FIG. 4A is a perspective view of the center anchor assembly of FIG. 2D, in accordance with various embodiments of the present disclosure.
Figure 4B:
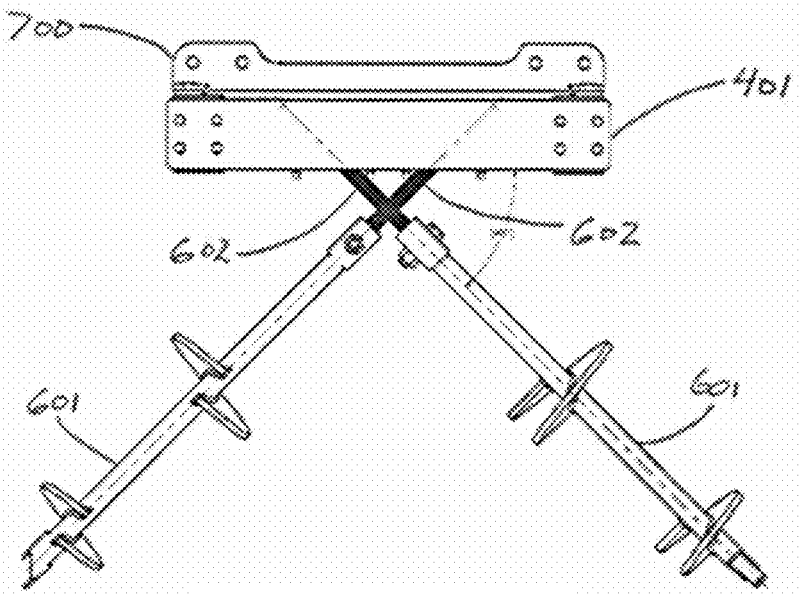
FIG. 4B is a front elevation of the center anchor assembly of FIG. 4A, in accordance with various embodiments of the present disclosure.

The center anchor assembly 400, shown in detail in FIG. 4A, comprises a welded structural steel frame 401 used to provide construction support for adjustable cross slide angles 302 and cross support weldments 301 to allow for adjusting locations for the laterally driven helical pile soil anchor assembly 600. A pivotal foundation support 700 is provided for robust attachment to the superstructure during construction. The welded structural steel frame 401 is prepared to accept a sectional spacer rail assembly 500 as required by the length of the desired mobile structure to be constructed.

Figure 4C:
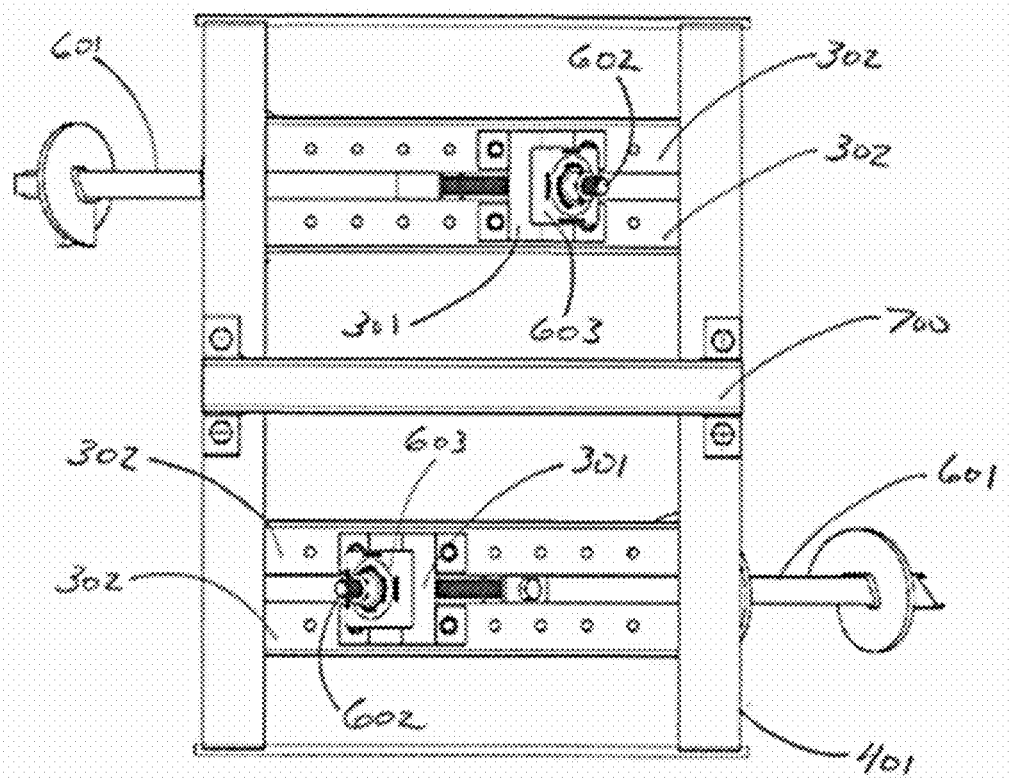
FIG. 4C is a top elevation of the center anchor assembly of FIG. 4A, in accordance with various embodiments of the present disclosure.
Figure 4D:
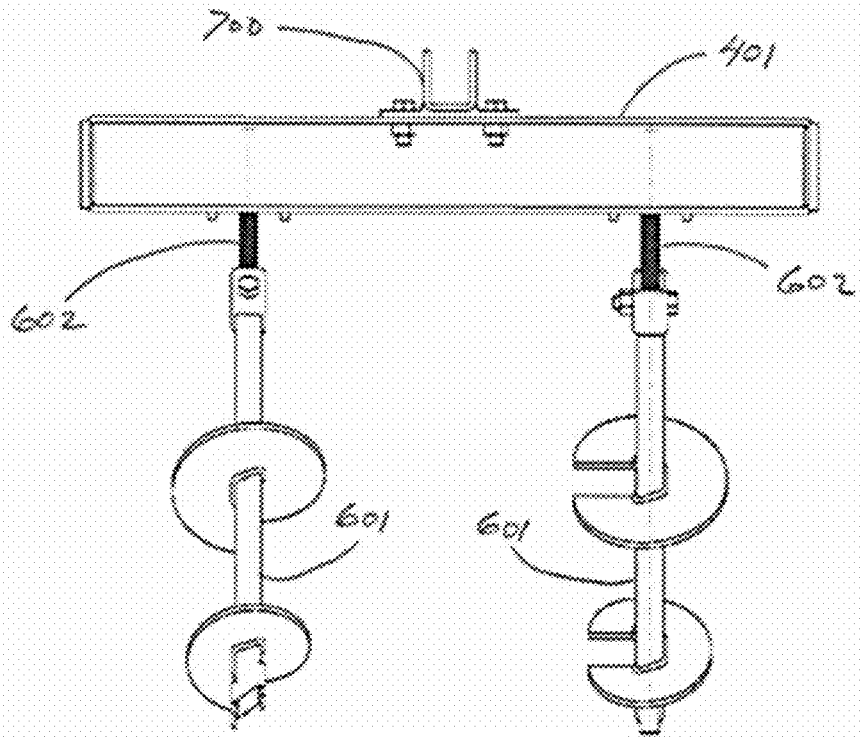
FIG. 4D is a side elevation of the center anchor assembly of FIG. 4A, in accordance with various embodiments of the present disclosure.

In the center anchor assembly 400 shown in FIG. 4C, helical soil anchors 601 are driven in for lateral support at approximately 45 degree angle. Once driven in place, a threaded rod 602 can be attached to each helical soil anchor 601 which can then be extended through the cross support weldment 301. The self-aligning anchorage termination 603 can be placed concentrically over the threaded rod 602 and affixed to transfer the tension or compression load bearing capacity of the soil stratum to the center anchor assembly 400.

Figure 5A:
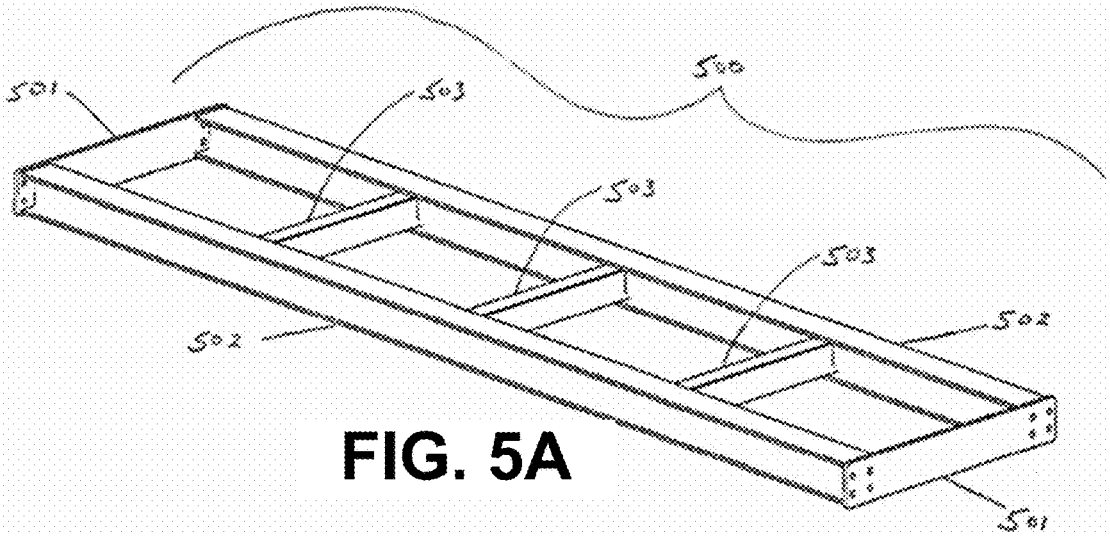
FIG. 5A is a perspective view of the sectional spacer rail extension assembly of FIG. 2D, in accordance with various embodiments of the present disclosure.
Figure 5B:
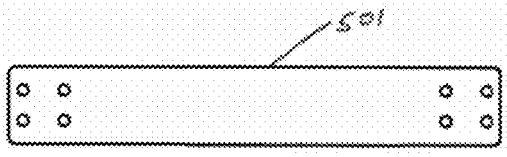
FIG. 5B is a front elevation of the sectional spacer rail extension assembly of FIG. 5A, in accordance with various embodiments of the present disclosure.
Figure 5C:
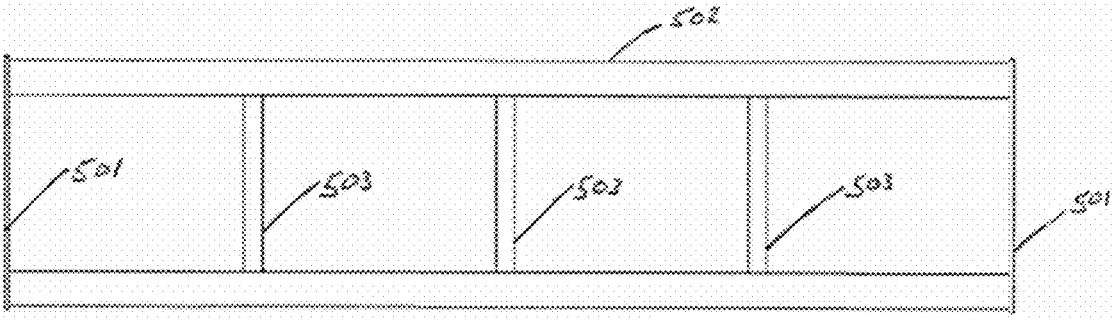
FIG. 5C is a top elevation of the sectional spacer rail extension assembly of FIG. 5A, in accordance with various embodiments of the present disclosure.
Figure 5D:
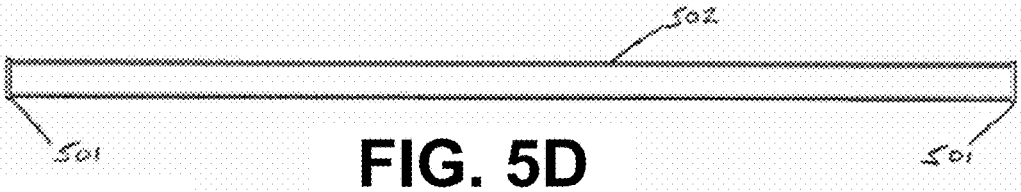
FIG. 5D is a side elevation of the sectional spacer rail extension assembly of FIG. 5A, in accordance with various embodiments of the present disclosure.

The sectional spacer rail assembly 500 of FIG. 5A is a welded structural steel frame made up of longitudinal members 502, cross support members 503, and end plates 501. The end plates 501 are prepared to accept fasteners to connect the sectional spacer rail assembly 500, which can be used to form any number of end anchor assemblies 300 or center anchor assemblies 400.

Figure 2A:
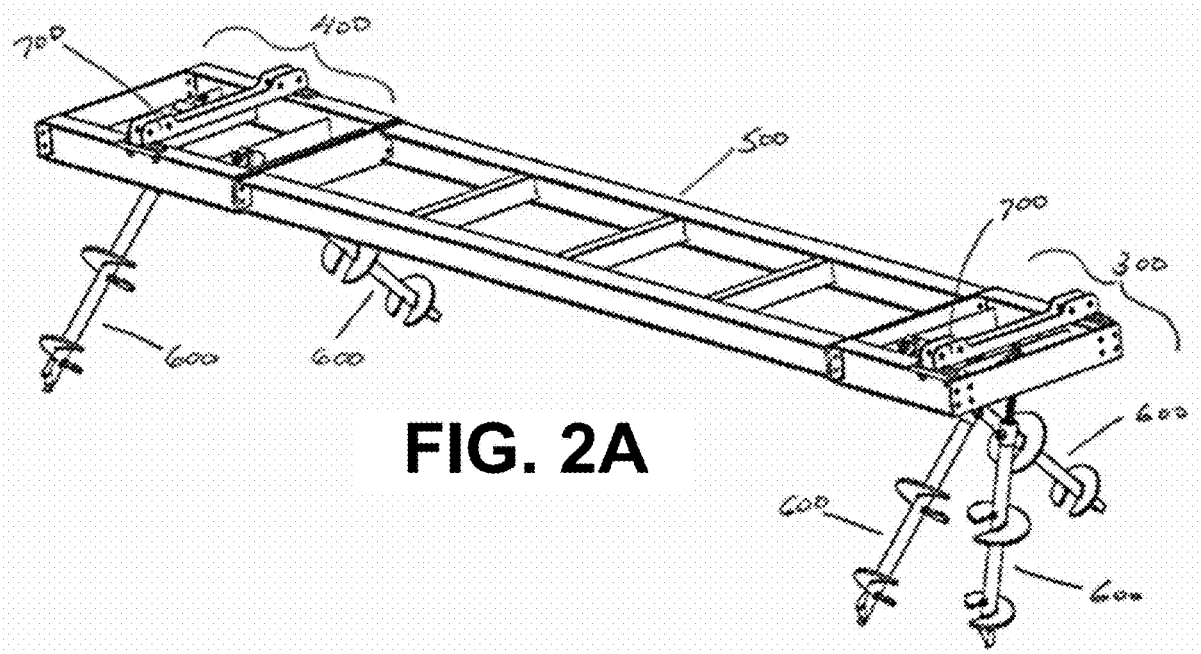
FIG. 2A is a perspective view of an example of a sub-assembly of the segmental rail foundation of FIG. 1A, in accordance with various embodiments of the present disclosure.
Figure 2B:
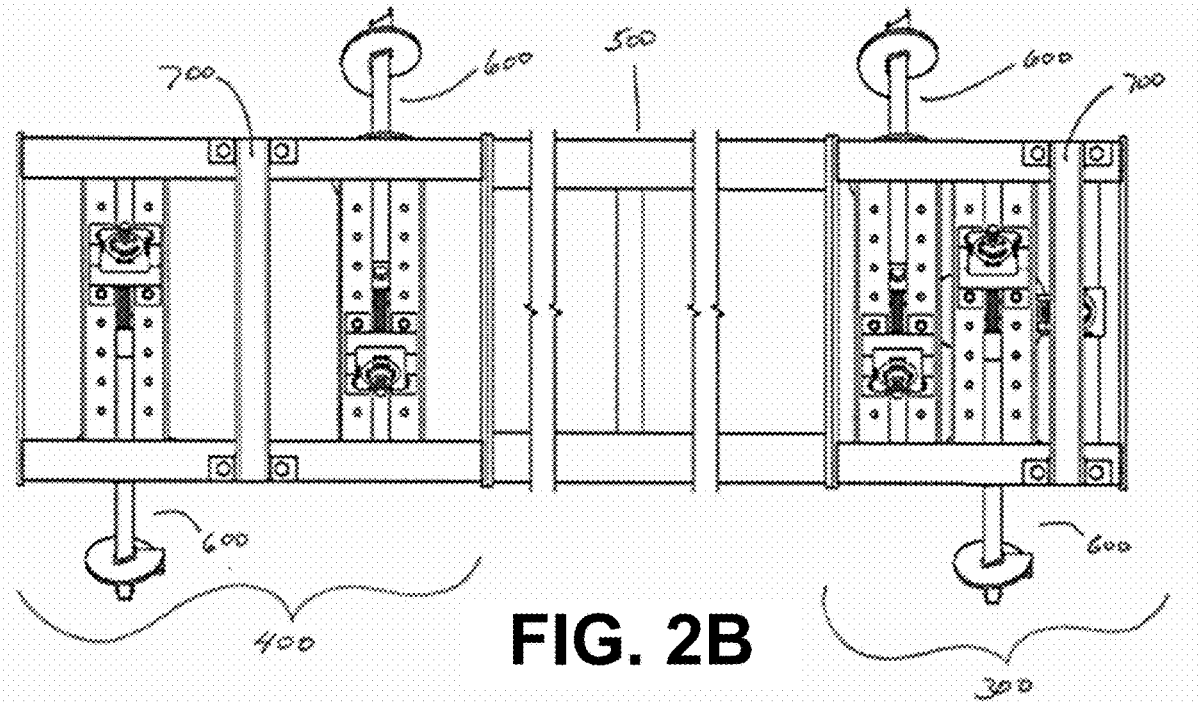
FIG. 2B is a top elevation of the sub-assembly of the segmental rail foundation of FIG. 2A, in accordance with various embodiments of the present disclosure.
Figure 2C:
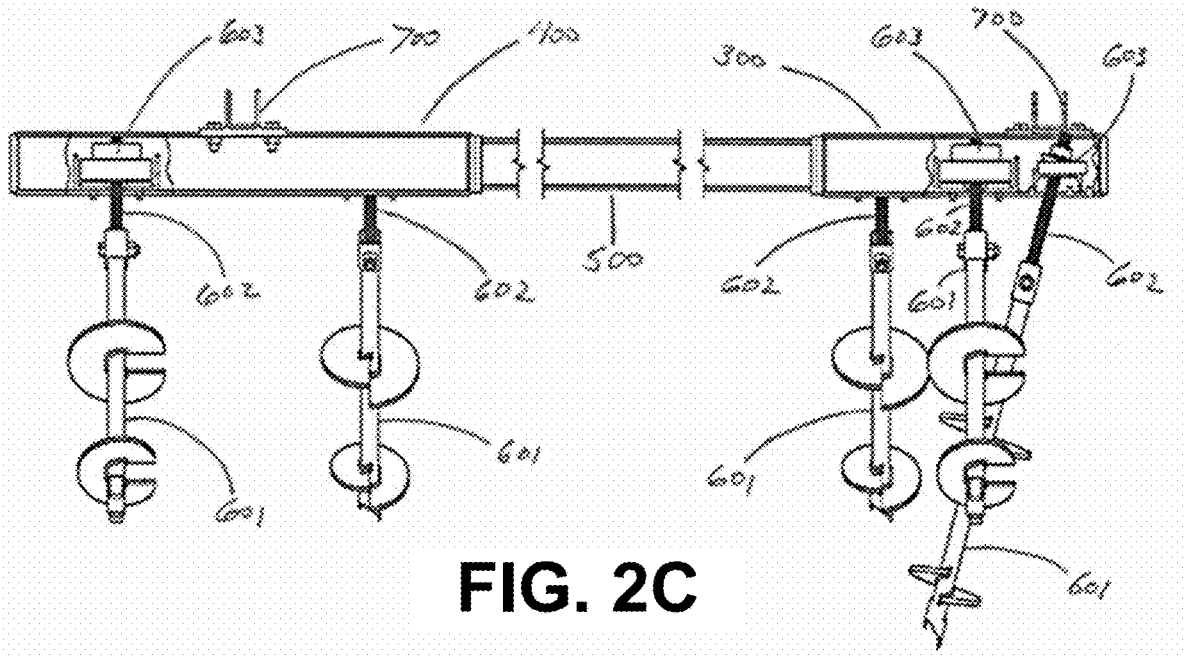
FIG. 2C is a side elevation view of the sub-assembly of the segmental rail foundation of FIG. 2A, in accordance with various embodiments of the present disclosure.
Figure 2D:
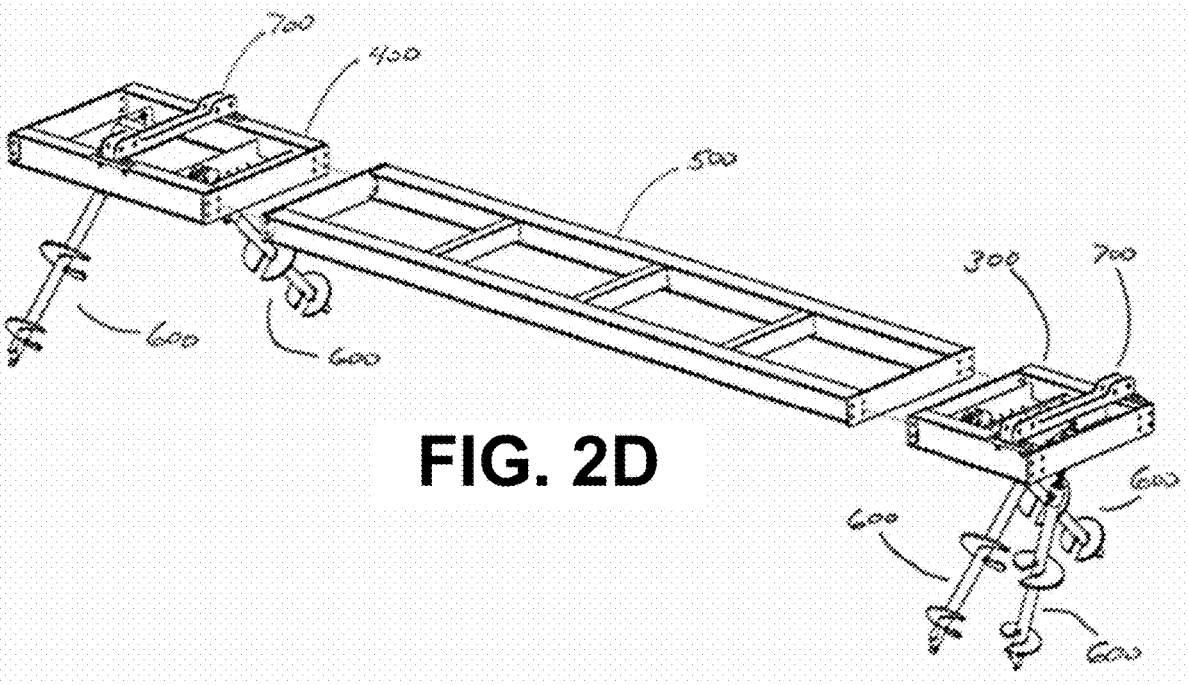
FIG. 2D is an exploded view of the sub-assembly of the segmental rail foundation of FIG. 2A, in accordance with various embodiments of the present disclosure.

The portion of the anchored segmental rail foundations 100 shown in FIG. 2D demonstrates the attachment of a singular end anchor assembly 300 and center anchor assembly 400 to the sectional spacer rail assembly 500, illustrating how a single or dual rail foundation 100 can be constructed to fit a myriad of mobile field applications.

Figure 8:
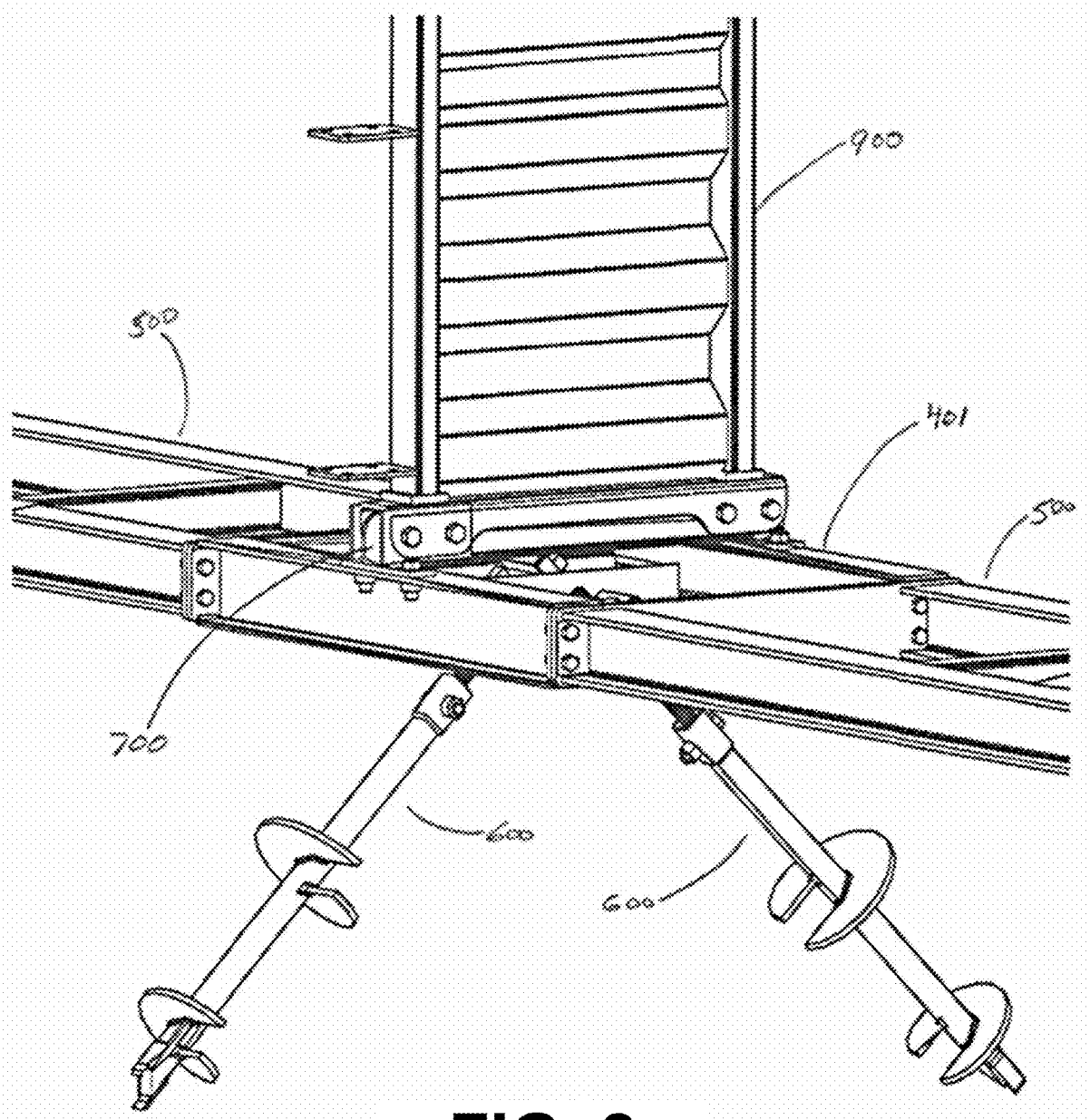
FIG. 8 is a perspective view of the pivotal foundation support of FIG. 7A at the center anchor assembly of FIG. 4A with a superstructure load attached, in accordance with various embodiments of the present disclosure.

FIG. 8 is a perspective view showing an example of a typical attachment of a support of the superstructure 900, to the pivotal foundation support 700 by means of fasteners such as, but not limited to, bolts, screws, pins, etc. This illustration shows the structure 900 mounted to a center anchor assembly 400 with the corresponding transverse located, laterally driven helical soil anchor assemblies 600. Attached to each side end of the center anchor assembly 400 is a sectional spacer rail assembly 500 to allow for the extension of the segmental rail foundation system to the desired system length.

Figure 9:
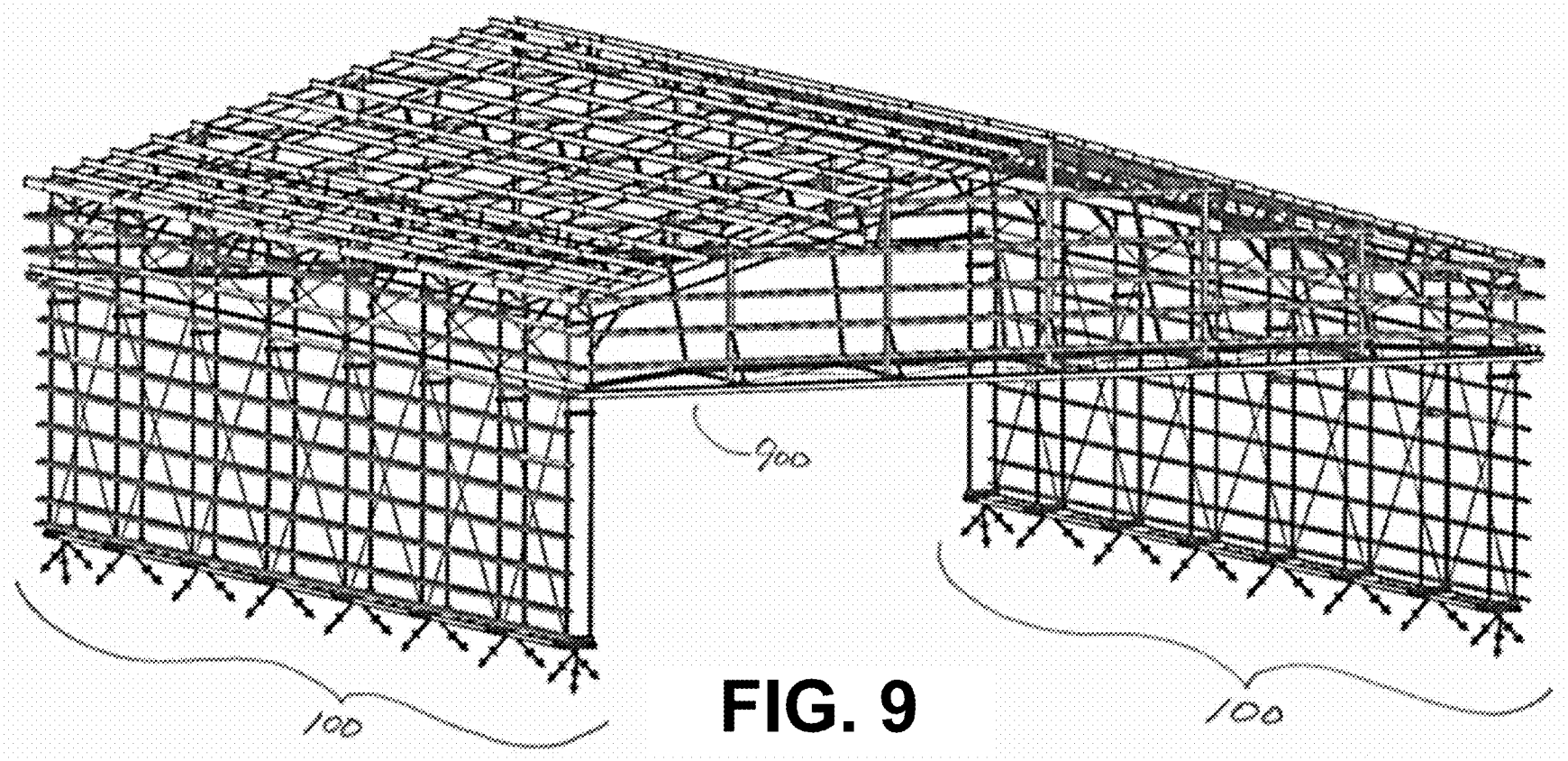
FIG. 9 is a perspective view of an example of an anchored segmental rail foundation with a superstructure load attached, in accordance with various embodiments of the present disclosure.

FIG. 9 is a perspective view showing a construction of two plural anchored segmental rail foundations 100, set in place to support the mobile superstructure 900. As is apparent in the illustration, the multiple center anchor assemblies 400 and four end anchor assemblies 300, provide ample number of helical pile assemblies 600 to support the superstructure 900. Wind and weather applied to the superstructure 900 from powerful storm systems can cause enormous forces to be created in both tension and compression which can efficiently be transferred into the load bearing soil through the anchored segmental rail foundations 100 and the numerous helical soil anchor assemblies 600.

In some deployments, there can exist infrastructure, concrete slabs, runways, taxiways, etc. that are still viable groundworks. These concrete slab constructions may have been constructed recently or many years ago. In most cases, there will not be testing and construction documents available supporting the quality or condition of this infrastructure. To account for the presence of the existing infrastructure, the segmental rail foundation 100 can be capable of connecting the sectional spacer rail assembly 500 to a concrete slab in lieu of or in addition to the use of the helical soil anchor assemblies 600.

Fixation of the segmental rail foundation 100 can be accomplished utilizing, e.g., drilled in place high-strength mechanical undercut anchors to affix a forked hold down plate bracket mounted on to and over the exterior and/or interior flanges of the longitudinal members of an end anchor assembly 300, center anchor assembly 400 and/or sectional spacer rail assembly 500 resting upon an existing concrete slab. This technique can also be used in tandem with helical soil anchor assemblies 600 in order to improve the uplift capacity of the segmental rail foundation 100 and the superstructure of a building.

Figure 10A:
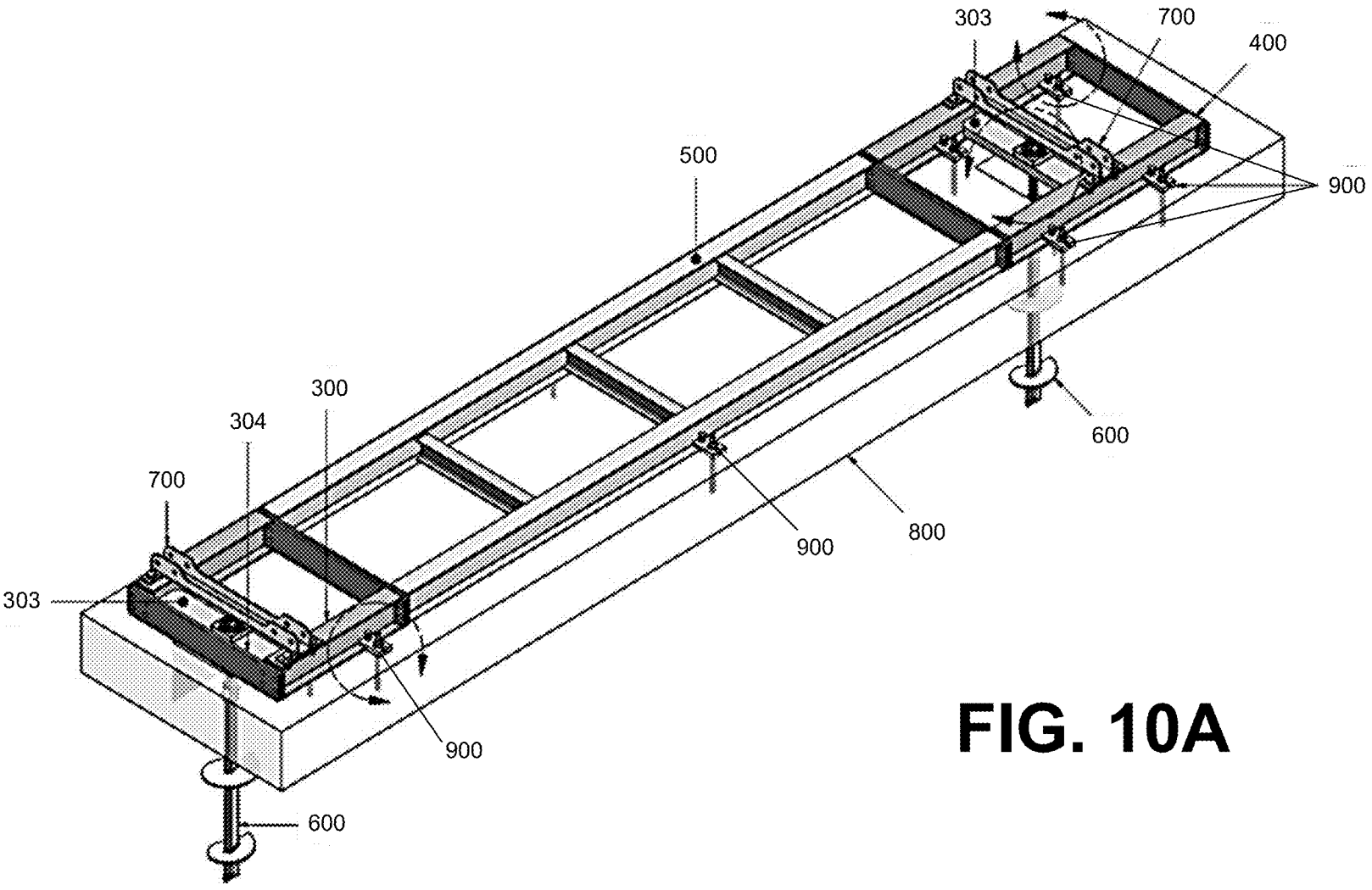
FIGS. 10A-10H illustrate an example of a sub-assembly of the segmental rail foundation for mounting over an existing infrastructure such as, e.g., a concrete slab, in accordance with various embodiments of the present disclosure.
Figure 10B:
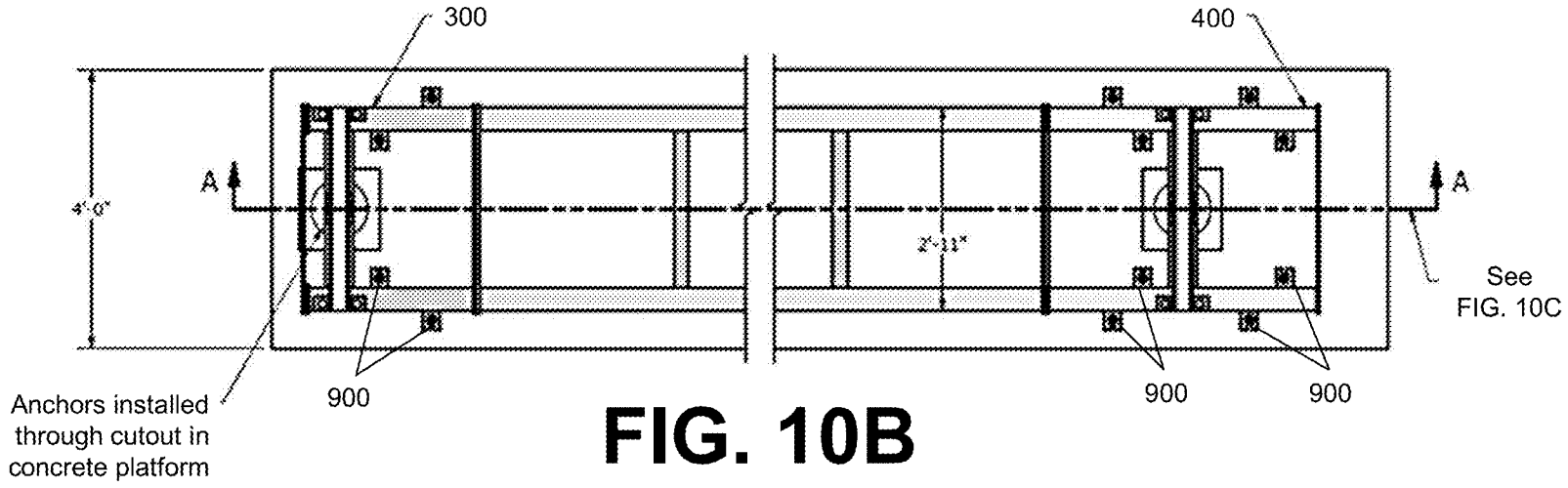
Figure 10C:
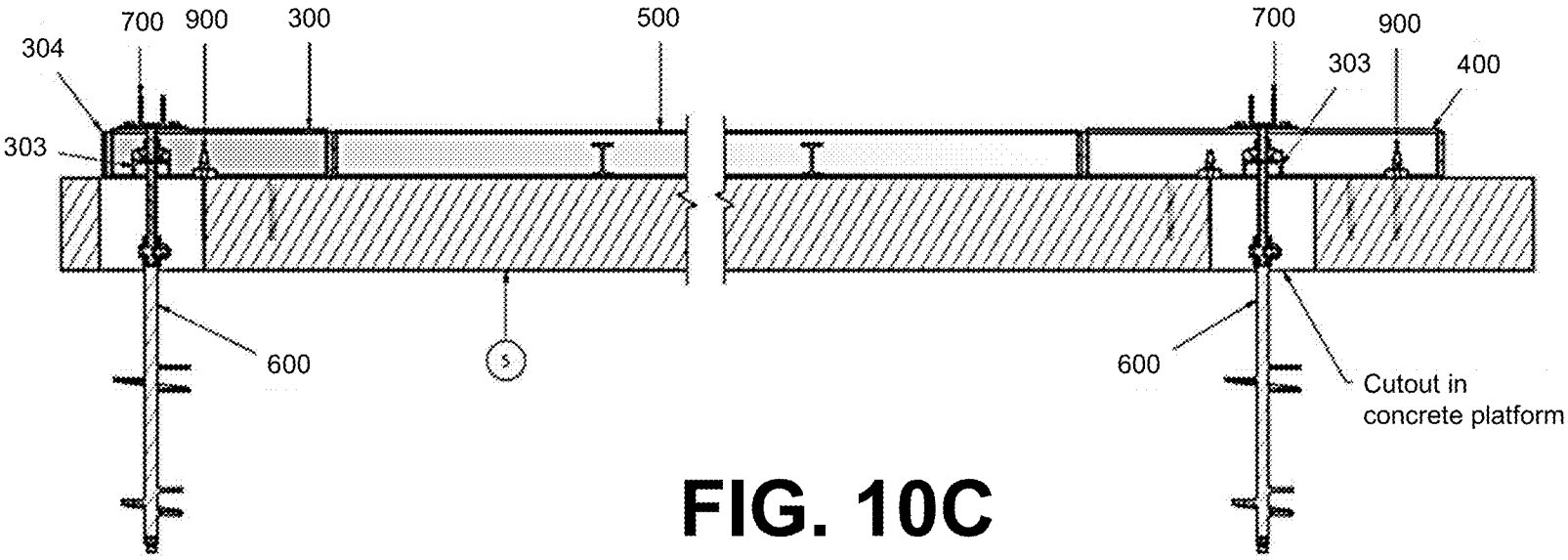

Referring to FIGS. 10A-10C illustrate an example of a segment of the segmental rail foundation 100, which includes a sectional spacer rail assembly 500 between an end anchor assembly 300 and a center anchor assembly 400. The assemblies 300, 400 and 500 can be coupled together by fasteners (e.g., bolts, screws, or other appropriate fasteners), which can facilitate later disconnection. The segmental rail foundation 100 can be anchored to the underlying surface or groundworks including, e.g., a slab of concrete 800 (e.g., a runway) by hold down assemblies 900, soil anchor assemblies 600, or a combination of both as shown. As can be seen in FIGS. 10A-10C, the end anchor assembly 300 is coupled to a soil anchor assembly 600 oriented substantially vertically for stability and the center anchor assembly 400 is coupled to a soil anchor assembly 600. Pivotal foundation supports 700 are coupled to the end and center anchor assemblies 300 and 400 over the soil anchor assemblies 600.

Hold down assemblies 900 can be used to connect the segmental rail foundation 100 directly to the slab 800 utilizing a forked plate or bracket 902 anchored to the existing concrete slab 800 to offset the loads to be imposed on the existing infrastructure by the superstructure of the hangar. The hold down assemblies 900 can be utilized with or without soil anchor assemblies 600, which can be included to provide additional resistance to large capacity uplift, lateral and compression loads.

Figure 10D:
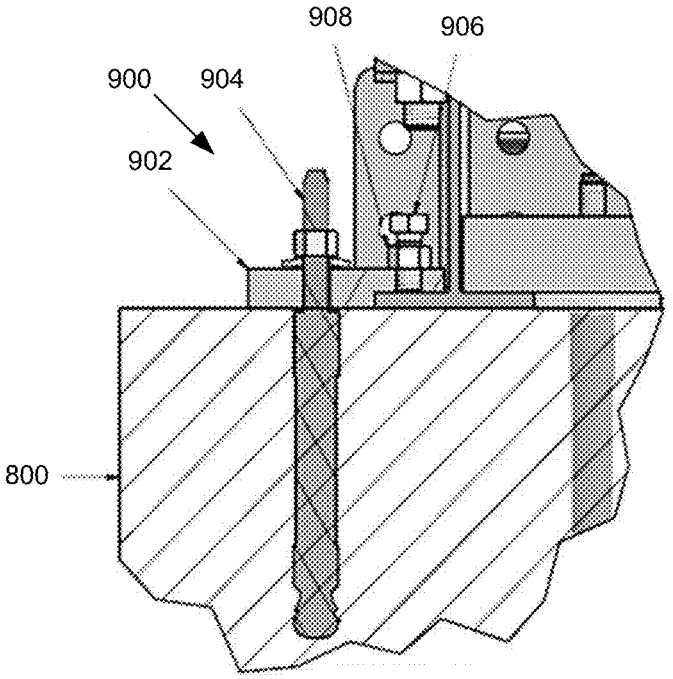

The forked hold down plate or bracket 902 can be a forged or prefabricated forked offset connector plate fashioned to sit firmly against a surface of the infrastructure 800 (e.g., a concrete slab or runway) when the forked hold down plate or bracket 902 is fitted adjacent and snug against exterior and/or interior flanges (e.g., rail or I-beam flange) of the longitudinal members of an end anchor assembly 300, center anchor assembly 400 and/or sectional spacer rail assembly 500. FIG. 10D is a cross-sectional view illustrating an example of a hold down assembly 900 comprising a forked hold down plate or bracket 902 secured over an exterior flange of the end anchor assembly 300 or center anchor assembly 400. A solid side interior edge of the forked hold down plate 902 is fitted snug against the exterior edge of the bottom of the steel rail or I-beam flange to provide for lateral stabilization of the assembly.

Figure 10E:
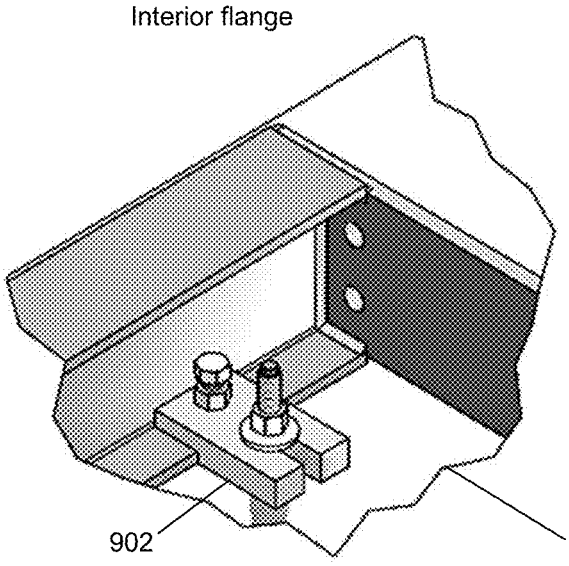
Figure 10F:
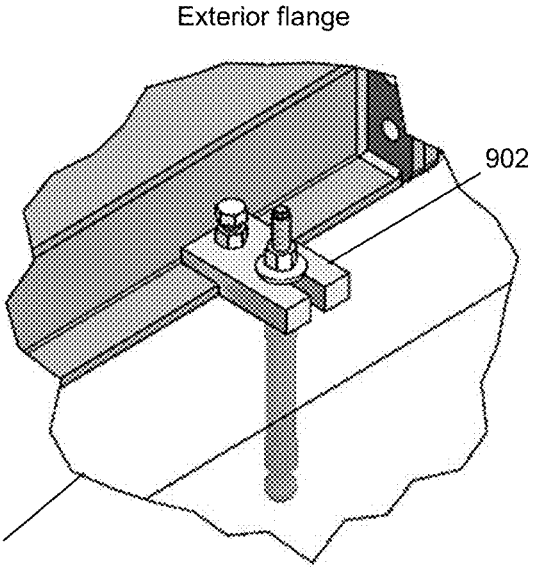

As seen in FIGS. 10E and 10F, the forked hold down plate 902 includes a forked portion which is secured against the surface of the slab 800 (or other infrastructure) and a haunch portion that extends over the flange of the assembly. The bottom of the forked portion or side of plate can be firmly secured against the surface of the concrete slab in connection to hold the haunch portion against the flange of the rail or I-beam. An anchor bolt 904 (e.g., a high-strength drilled in-place mechanical concrete threaded swedge anchor bolt) can be drilled and inserted within the infrastructure 800

(e.g., a concrete slab or runway). The anchor bolt 904 can be positioned within the fork of the forked hold down plate 902 where the minimum embedment of the anchor can be best achieved. The fork allows for adjustment of the anchor bolt placement in order to miss any reinforcing steel during the installation of anchor bolt 904 along the length of the interior of the fork side of said forked plate connector. The anchor bolt 904 can then be affixed to the top surfaces of the fork side or portion of the forked hold down plate 902 using, e.g., a nut and washer (or spacer) or other appropriate fastener, with the haunch portion affixed in place over the flange.

The solid haunch portion of the forked hold down plate 902 extends over the flange of the steel rail or I-beam in a hold down position and can be fitted with a drilled and threaded vertical hole of a specified diameter. A hold down bolt 906 of the same diameter and thread size can be inserted into the hole, which is aligned over the top surface of the flange. The hold down bolt 906 can be turned until the end of the hold down bolt 906 contacts the top surface of the flange and can be adjusted to apply a holding force against the flange of the assembly. The hold down bolt 906 is utilized in completing a positive connection between the flange and the assembly and the concrete slab or infrastructure 800 utilizing the forked hold down plate 902. The hold down bolt 904 can eliminate potential free-play between the forked hold down bracket 902 and the flange. A locking nut 908 can be included to secure the hold down bolt 906 in position and prevent loosening of the connection. As illustrated in FIGS. 10E and 10F, the forked hold down plate 902 of the hold down assembly 900 can be located on either an interior or exterior flange of the end anchor assembly 300, center anchor assembly 400 and/or sectional spacer rail assembly 500.

Figure 10G:
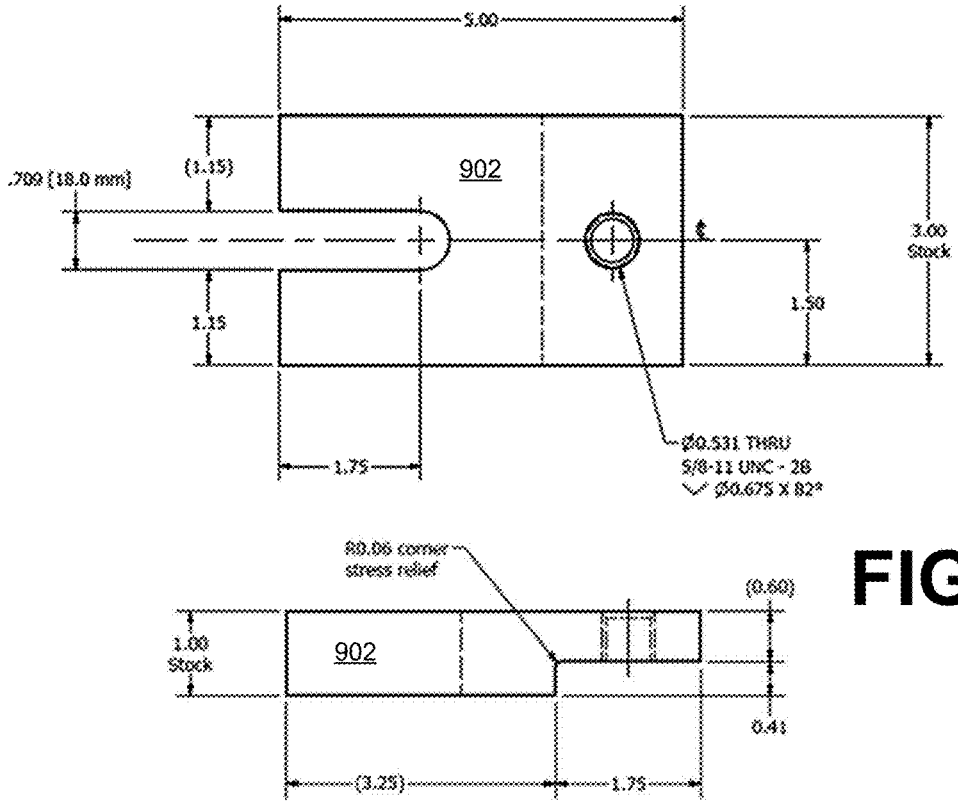

FIG. 10G provides top and side views of a forked hold down plate 902. The forked portion or side includes a slot extending inward from an edge of the plate to allow for variations in the anchor bolt 904 location. In the solid haunch portion, a threaded hole is provided for the hold down bolt 906. The threaded hole can be substantially centered in the haunch portion. As seen in the side view, the forked portion of the forked hold down plate 902 is thicker than the haunch portion. The difference in thickness allows the forked portion to be secured against the surface of the infrastructure 800 (e.g., concrete slab) while the haunch portion extends over the flange of the end anchor assembly 300, center anchor assembly 400 and/or sectional spacer rail assembly 500. This design allows the forked hold down plate to be adjusted along the length of the flange to account for variations in the installation of the anchor bolt 904 in the slab 800 should obstructions (e.g., reinforcing steel bars) be encountered or based upon results of strength testing of the existing concrete slab infrastructure 800. Shims may be used depending upon the condition and smoothness of the existing infrastructure 800 encountered.

Prior to connecting the forked hold down plates to the segmental rail foundation 100, the existing infrastructure 800 can be strength tested to determine the placement of the forked hold down plates 902 along the rail. This testing can also be used to determine how many hold down plates 902 should be included based upon expected loading of the segmental rail foundation 100. Concrete testing can be accomplished using concrete test cylinders obtained at the job site, curing them properly and sending them to a concrete testing lab for crushing to determine the PSI strength of the concrete.

If testing labs are unavailable, then other methods of testing may be utilized (e.g., pull-out testing, rebound hammer testing or ultrasonic pulse velocity testing). For concrete pull-out testing, key points along the segmental rail foundation can be drilled and a mechanical anchor inserted, pull-tested and the results correlated to a chart of capacities. For rebound hammer testing, a Schmidt or Swiss rebound hammer can be used to measure the rebound of a spring-loaded mass impacting against the surface of the concrete sample. The rebound value is dependent on the hardness of the concrete and can be used to determine the concrete's compressive strength in PSI.

Once the existing infrastructure 800 has been evaluated, a high-strength carbon or stainless-steel anchor bolt 904 can be selected. Depending upon the depth of embedment and the condition and strength of the existing infrastructure slab 800, the anchor bolts can possess a pull-out capacity ranging from about 15,000 lbs. to about 28,000 lbs. depending upon the bolt diameters, and a shear strength of between about 32,257 lbs. to about 60,452 lbs. These values are substantial and offer superior capacities when compared to other type of mechanical anchoring devices.

Figure 10H:
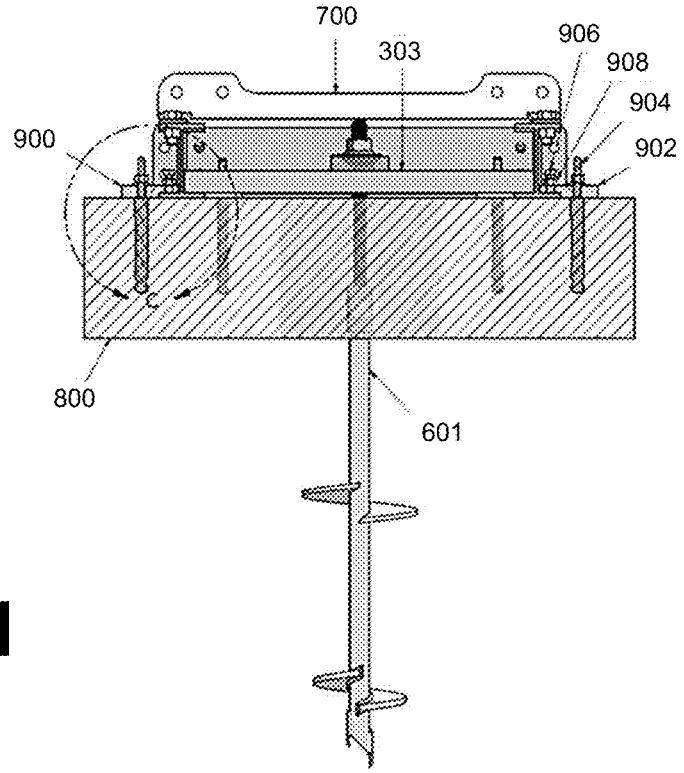

As previously discussed, the hold down assemblies 900 can be utilized with or with soil anchor assemblies 600. In the example of FIGS. 10A-10C, soil anchor assemblies 600 are included to increase the load handling capabilities of the segmental rail foundation 100. As illustrated in FIG. 100, soil anchor assemblies 600 can be installed through cutouts in the infrastructure 800 and secured to the end anchor assembly 300 or center anchor assembly 400 by an end cross slide channel 303. FIG. 10H is a cross-sectional view showing a helical soil pile anchor 601 secured in the soil substrate below, e.g., a concrete slab 800. The helical soil pile anchor 601 is secured to the end anchor assembly 300 or center anchor assembly 400 using the end cross slide channel 303 extending across the inside of the assembly. In the example of FIG. 10H, hold down assemblies 900 are also secured on the external sides of the assembly.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

The term "substantially" is meant to permit deviations from the descriptive term that don't negatively impact the intended purpose. Descriptive terms are implicitly understood to be modified by the word substantially, even if the term is not explicitly modified by the word substantially.

It should be noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to about 5%" should be interpreted to include not only the explicitly recited concentration of about 0.1 wt % to about 5 wt %, but also include individual concentrations (e.g., 1%, 2%, 3%, and 4%) and the sub-ranges (e.g., 0.5%, 1.1%, 2.2%, 3.3%, and 4.4%) within the indicated range. The term "about" can include traditional rounding according to significant figures of numerical values. In addition, the phrase "about 'x' to 'y'" includes "about 'x' to about 'y'".

Therefore, at least the following is claimed:

1. A mobile rail foundation system, comprising:

a segmental rail foundation including:

a plurality of anchor assemblies, where each of the plurality of anchor assemblies couples to a plurality of soil anchor assemblies, the plurality of soil anchor assemblies comprising end anchor assemblies coupled to first and second lateral soil anchor assemblies and a longitudinal support soil anchor assembly, wherein the end anchor assemblies comprise:

an end cross slide channel configured to couple to the longitudinal support soil anchor assembly, and first and second pairs of cross slide angles configured to couple to the first and second lateral soil anchor assemblies via cross support weldments; and at least one sectional spacer rail assembly configured to detachably attach adjacent anchor assemblies to form the segmental rail foundation.

2. The mobile rail foundation system of claim 1, comprising foundation supports affixed to at least a portion of the plurality of anchor assemblies.

3. The mobile rail foundation system of claim 2, wherein the foundation supports are configured to couple to vertical supports of a structure.

4. The mobile rail foundation system of claim 1, wherein the longitudinal support soil anchor assembly extends into soil supporting the segmental rail foundation, the longitudinal support soil anchor assembly substantially aligned with a longitudinal axis of the segmental rail foundation.

5. The mobile rail foundation system of claim 4, wherein the longitudinal support soil anchor assembly extends into the soil at an angle of about 15 degrees from normal of a surface of the soil.

6. The mobile rail foundation system of claim 4, wherein the first and second lateral soil anchor assemblies extend into the soil in opposite directions, the first and second lateral soil anchor assemblies substantially perpendicular to the longitudinal axis of the segmental rail foundation.

7. The mobile rail foundation system of claim 6, wherein the first and second lateral soil anchor assemblies extend into the soil at an angle of about 45 degrees from normal of a surface of the soil.

8. The mobile rail foundation system of claim 1, wherein the first and second pairs of cross slide angles extend across a proximal end of the anchor assemblies configured to attach to the at least one sectional spacer rail assembly, and the end cross slide channel extends across a distal end of the end anchor assemblies.

9. The mobile rail foundation system of claim 1, wherein the plurality of anchor assemblies comprise a center anchor assembly coupled to two soil anchor assemblies, the center anchor assembly attached between two sectional spacer rail assemblies.

10. The mobile rail foundation system of claim 1, comprising a second segmental rail foundation comprising a plurality of anchor assemblies and at least one sectional spacer rail assembly configured to detachably attach adjacent anchor assemblies to form the second segmental rail foundation.

11. The mobile rail foundation system of claim 10, wherein each of the plurality of anchor assemblies of the second segmental rail foundation is configured to couple to a plurality of soil anchor assemblies.

12. The mobile rail foundation system of claim 10, wherein a foundation support is affixed across individual anchor assemblies of the plurality of anchor assemblies of the second segmental rail foundation.

13. The mobile rail foundation system of claim 12, wherein the segmental rail foundations are substantially parallel, and the foundation supports are configured to couple to vertical supports of a structure supported by the segmental rail foundations.

14. The mobile rail foundation system of claim 1, wherein the plurality of soil anchor assemblies comprise helical soil pile anchors.

15. A mobile rail foundation system, comprising:

a segmental rail foundation including:

a plurality of anchor assemblies, where each of the plurality of anchor assemblies couples to a plurality of soil anchor assemblies, the plurality of anchor assemblies comprising a center anchor assembly coupled to first and second lateral soil anchor assemblies; and a plurality of sectional spacer rail assemblies configured to detachably attach adjacent anchor assemblies to form the segmental rail foundation, the center anchor assembly attached between two sectional spacer rail assemblies, wherein the center anchor assembly comprises first and second pairs of cross slide angles configured to couple to the first and second lateral soil anchor assemblies via cross support weldments.

16. The mobile rail foundation system of claim 15, wherein the plurality of anchor assemblies comprise end anchor assemblies coupled to three soil anchor assemblies.

17. The mobile rail foundation system of claim 15, wherein the first and second lateral soil anchor assemblies extend into the soil at an angle of about 45 degrees from normal of a surface of the soil.

18. The mobile rail foundation system of claim 15, wherein a foundation support is affixed across the center anchor assembly between the first and second pairs of cross slide angles.

19. The mobile rail foundation system of claim 15, wherein the plurality of soil anchor assemblies comprise helical soil pile anchors.

20. The mobile rail foundation system of claim 19, wherein each of the helical soil pile anchors are coupled to one of the plurality of anchor assemblies via a threaded rod and a self-aligning anchorage termination.

21. The mobile rail foundation system of claim 15, comprising a hold down assembly configured to couple an anchor assembly of the plurality of anchor assemblies to an infrastructure located below the segmental rail foundation.

22. The mobile rail foundation system of claim 21, wherein the hold down assembly comprises a forked hold down plate secured to the infrastructure.

23. The mobile rail foundation system of claim 21, wherein the forked hold down plate is secured by an anchor bolt in a concrete slab of the infrastructure.

* * * * *